US008413763B2

(12) United States Patent
Hermann et al.

(10) Patent No.: US 8,413,763 B2
(45) Date of Patent: Apr. 9, 2013

(54) FIREFIGHTERS TRACER LINE APPARATUS

(75) Inventors: Ronald William Hermann, Rocklin, CA (US); Andrew Hudson, Santa Rosa, CA (US); Caralin Adair, Santa Rosa, CA (US)

(73) Assignee: Rescue Products, Inc., El Dorado Hills, CA (US)

( * ) Notice: Subject to any disclaimer, the term of this patent is extended or adjusted under 35 U.S.C. 154(b) by 331 days.

(21) Appl. No.: 12/731,064

(22) Filed: Mar. 24, 2010

(65) Prior Publication Data

US 2010/0243783 A1 Sep. 30, 2010

Related U.S. Application Data

(60) Provisional application No. 61/210,876, filed on Mar. 24, 2009.

(51) Int. Cl.
*A62B 35/00* (2006.01)

(52) U.S. Cl. ..... 182/18; 182/231

(58) Field of Classification Search ..... 182/18, 182/231, 236; 242/385, 385.4, 377; 362/258, 362/387

See application file for complete search history.

(56) References Cited

U.S. PATENT DOCUMENTS

| | | | | |
|---|---|---|---|---|
| 2,680,593 | A | 6/1954 | McIntyre | |
| 3,423,044 | A | 1/1969 | Beiderwell | |
| 3,865,329 | A * | 2/1975 | Higbee et al. | 242/383.1 |
| 4,161,266 | A | 7/1979 | Howarth | |
| 4,588,046 | A | 5/1986 | Van der Neer et al. | |
| D298,214 | S | 10/1988 | Adachi | |
| 4,877,110 | A | 10/1989 | Wolner | |
| 5,042,613 | A | 8/1991 | Hermann | |
| 5,173,067 | A | 12/1992 | Biba | |
| 5,581,901 | A | 12/1996 | Takahashi | |
| 5,920,997 | A * | 7/1999 | Girtman | 33/414 |
| 6,182,789 | B1 | 2/2001 | Okamura | |
| 6,317,047 | B1 | 11/2001 | Stein et al. | |
| 6,810,997 | B2 | 11/2004 | Schreiber et al. | |
| 7,234,828 | B2 | 6/2007 | Kelly | |
| 7,481,399 | B2 | 1/2009 | Nohren et al. | |
| 2002/0100244 | A1 * | 8/2002 | Carroll | 52/698 |
| 2002/0158160 | A1 * | 10/2002 | Shimizu | 242/223 |
| 2005/0217937 | A1 * | 10/2005 | Rohlf | 182/232 |
| 2007/0008719 | A1 * | 1/2007 | Hill | 362/198 |
| 2007/0186433 | A1 * | 8/2007 | Campbell | 33/767 |
| 2010/0025157 | A1 | 2/2010 | Casebolt | |

* cited by examiner

*Primary Examiner* — Katherine Mitchell
*Assistant Examiner* — Kristine Florio
(74) *Attorney, Agent, or Firm* — David A. Guerra

(57) ABSTRACT

A rescue line apparatus is configured as a horizontal tether for being readily connected between a door and a portion of the door jamb or other entry location and extending a line as the user moves within the structure. The device allows the user to readily locate their way back for egressing the structure, and can be readily disengaged by the user, which activates a braking system that prevents unit "run-away". A multi-attach anchor head couples the far end of the line to any desired structure, and has a beacon assembly which outputs a light pattern of sufficient brightness to be seen by the user when visually locating their attachment point within the structure. A multi-element visual indicator is configured for indicating line extension distance, and displaying tether line status. Many options promote safety and a fully cooperative environment.

20 Claims, 13 Drawing Sheets

FIREFIGHTERS TRACER LINE APPARATUS

CROSS-REFERENCE TO RELATED APPLICATIONS

This application claims priority from U.S. provisional application Ser. No. 61/210,876 filed on Mar. 24, 2009, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to fire fighting safety devices, and more particularly to horizontal Rescue and Search tether lines for directing one or more fire crews, Urban Search and Rescue Team (USART), or other rescue workers within a rescue or firefighting situation.

2. Description of Related Art

Often in the course of fire fighting, and/or rescue, it is necessary to traverse within a structure (e.g., typically from a point of ingress and/or intended egress) to perform various duties, including fire suppression and/or searching for and rescuing individuals which may be found therein. For example, a fire fighter may enter a room and move about through the smoke of that room in the performance of their duties. Upon attempting to egress that room, the limited visibility and conditions often make it very difficult for the individual to readily locate the point of ingress from which they entered the room. As a result, fire fighters can be seriously injured or lose their lives attempting to locate the way back out of a room in a burning structure.

Toward remediating the situation, fire fighters have relied upon the use of a rope line which is played out from a bag as they traverse the room. In order to leave the room, the firefighter follows the rope back out to the doorway or entry point.

A number of problems have arisen with the use of these simple rope bag mechanisms, spawning an improved safety line solution as described by a prior patent issued to the inventor. Although providing additional safety and convenience over conventional rope bags, these devices still had operative limitations.

Accordingly, a need exists for a system and method for providing a safety line for fire fighters which overcomes the shortcomings of existing solutions, while introducing additional benefits in fire fighting and rescue situations.

BRIEF SUMMARY OF THE INVENTION

The apparatus described herein is a next generation safety line device for use by fire fighters and search and rescue personnel, and referred to by the name "Tracer Line II". The terms "fire crews" and "fire fighters" will be used generically herein to refer without limitation to any individuals utilizing the present invention in the performance of fire fighting and rescue duties, including fire crews, fire fighters, rescue workers, Urban Search and Rescue Team (USART) members, and so forth. The safety line according to the present invention is designed to provide significant operating benefits. The new tracer-line device is a multi-functional, self-contained safety location line which facilitates one-handed operation for safe ingress and egress from a search environment, provides improved line handling, and a number of additional safety features.

The new safety line device is readily attached to an individual, such as to an air pack harness or belt, and can be readily disconnected in the event of entanglement or other situations. The unit contains a sufficient length of non-corrosive, self-retracting, heat-resistant tether line. In at least one implementation of the invention the tether line is non-conductive. In at least one implementation of the invention the tether line is configured with a reflective and/or light-emissive tether line.

At the anchor end of the tether line is a multiple-attach anchoring mechanism (head) configured for allowing the user to simultaneously tie off and secure entry doors in an open position, wherein personnel need not work with various wooden wedges, or carry other implements for securing entry doors. In addition, the door-jamb anchoring mechanism in at least one embodiment has additional functions, including a beacon annunciating the entry door location (e.g., a beacon light). The device is made to easily and one-handedly attach to any door-jamb, keeping the door open for smoke ventilation and preventing dangerous door closure. If the space between a door and a door-jamb is not available for anchoring the head, the multi-attach anchor mechanism can be attached to the structure in various other ways, including a clamping configuration or by tying off to the structure or elements therein, or interconnection with another tracer line, or a mother-line and so forth. The apparatus of the present invention is particularly well-suited for use in room-to-room building searches and the extended tether line allows searching of residential dwellings. This new apparatus can be utilized for many related applications, such as by petroleum platform fire fighters, naval fire fighting operations and even in certain underwater scuba operations.

The invention is amenable to being embodied in a number of ways, including but not limited to the following descriptions.

One embodiment of the invention is an apparatus for coupling and maintaining a rescue line (horizontal tether line) from a user to a structural attach point, comprising: (a) a housing configured for attachment to, and wearing by, a user; (b) a spool retained in the housing and configured with a predetermined length of line having a proximal end coupled to the spool and configured for being retained as windings on the spool; (c) a retraction mechanism, within the housing, coupled to the spool which is configured for extending line from the spool in response to application of an extension force; (d) a retraction brake mechanism, coupled to the retraction mechanism, configured for stopping line retraction in response to the housing becoming disengaged from the user; (e) a multi-attach anchor head coupled to the distal end of the length of line and configured with a twist-lock engagement mechanism for anchoring to a door and frame, or other structural member, as an attachment point within a structure; and (f) a beacon assembly disposed on the multi-attach anchor head and configured for outputting a light pattern to facilitate user locating of the attachment point within the structure. The beacon is configured for automatically activating in response to extension of the multi-attach anchor head from the housing, and can be configured in one mode of the invention to generate one of a plurality of lighting patterns.

At least one implementation of the above embodiment includes a belt clip which attaches to the housing and is configured for attachment to a belt, harness, and/or strap of the user, in response to the attachment to, and wearing by the user. The retraction brake mechanism of the device operates in response to (is activated by) the belt clip being disengaged from the housing, and thus separated from the user. This prevents an extended tracer line from "running away" from the user, when it is removed from the user and set down, such as if the user is adjusting their equipment. In at least one implementation, the belt clip is configured with a dual locking mechanism in which the belt, harness and/or strap is engaged by a first mechanism which is engaged and locked to a second mechanism, toward preventing disengagement of the belt, harness and/or strap. In a preferred implementation, locking of the second mechanism is controlled in response to user manipulation of one or more locking buttons, or similar user manipulated mechanical controls.

In at least one implementation, the housing is configured for extending line from either the front side or the rear side of the housing. In at least one preferred implementation, a plurality of rollers are disposed about the internal periphery of the housing to guide the line onto the spool in a desired arrangement, and can provide some retraction and extension speed limitation.

The multi-attach anchor head according to one or more implementations is configured for engaging any solid structures or coupling the line around an object and back to itself to secure the anchor. The multi-attach anchor head is configured for anchoring to a portion of the structure being retained between a first portion of the multi-attach anchor head and a second portion of the multi-attach anchor head. A preferred twist-lock engagement mechanism is configured to lock the first portion of the multi-attach anchor head to prevent motion in relation to the second portion of the multi-attach anchor head to provide a secure anchoring of the multi-attach anchor head to the structure.

At least one implementation of the embodiment further comprises a debris guard, and more preferably a multiple stage debris guard which is configured for removing debris from the line as it is retracted into the housing, and to direct liquids to fall through a slotted retraction opening in the housing.

At least one implementation of the embodiment further comprises a multi-element indicator configured for outputting a discrete lighting pattern indicative of the amount of line which has been extended from the housing. The discrete lighting pattern comprises a pattern of solid and blinking lights which indicate predetermined thresholds of line extension have been reached.

At least one implementation of the embodiment further comprises a power spring within the retraction mechanism which is geared up through concentric gears to drive the spool, which rotates a plurality of times for each rotation of the power spring.

One embodiment of the invention is an apparatus for coupling and maintaining a rescue line from a user to a structural attach point, comprising: (a) a housing; (b) a belt clip which attaches to the housing and is configured for attachment to a belt, harness, and/or strap, of a user, for wearing by the user; (c) a spool retained in the housing and configured with a length of line having a proximal end coupled to the spool and configured for being retained as windings on the spool; (d) a retraction mechanism within the housing and coupled to the spool which is configured for extending line from the spool through either the front side or rear side of the housing in response to application of a sufficient extension force; (e) a retraction brake mechanism, coupled to the retraction mechanism, configured for stopping line retraction when the housing is disengaged from the user; wherein the retraction brake mechanism operates in response to the belt clip being disengaged (removed) from the housing; (f) a multi-attach anchor head coupled to the distal end of the length of line and configured with an engagement mechanism for anchoring to a door and frame, or other structural member, as an attachment point within a structure; and (g) a beacon assembly, on the multi-attach anchor head, configured for outputting a light pattern to facilitate user locating of the attachment point within the structure.

At least one implementation is configured so that the retraction brake mechanism engages its brake in response to the belt clip being disengaged from the housing, such as in response to user disengagement. The belt clip is preferably configured with a dual locking mechanism in which the belt, harness and/or strap is engaged by a first mechanism which is then engaged and locked into a second mechanism, toward preventing disengagement the belt, harness and/or strap. The locking of the second mechanism is controlled in response to user manipulation of one or more locking buttons, or similar user controlled mechanical inputs.

Implementations of the invention can be configured with different forms of anchor heads to provide specific benefits for different application. The following are provided by way of example. In one implementation the anchor head comprises a pivoting chock element which extends from a nosepiece of the multi-attach anchor head in response to pressure applied to a handle of the multi-attach anchor head for insertion and rotation in the gap between a door and the door frame; and a twist lock mechanism, in the multi-attach anchor head, which engages upon release of the handle to set the anchor in a locked position which prevents re-extension of the chock and locks out rotation thereof. Another anchor head is described as a planar capture structure, which extends from the multi-attach anchor head, configured for engaging a structural member of a building within a channel area through a spring entry opening for anchoring the multi-attach anchor head to the building; and a pair of extendable engagement flaps which deploy in response to movements of a handle portion of the multi-attach anchor head and operates in conjunction with the planar capture structure for anchoring to the structural member.

One embodiment of the invention is an apparatus for maintaining a rescue line from a user to a point of ingress or egress within a structure, comprising: (a) a housing configured for attachment to, and wearing, by a user; (b) a spool retained in the housing and configured with a length of line having a proximal end coupled to the spool and configured for being retained as windings on the spool; (c) a retraction mechanism within the housing and coupled to the spool which is configured for extending line from the spool in response to application of a sufficient extension force; (d) a retraction brake mechanism, coupled to the retraction mechanism, configured for stopping line retraction when the housing is disengaged from the user; (e) a multi-element visual indicator configured for detecting the movement of one of the plurality of rollers and outputting a visual indication of line extension in response thereto; (f) a multi-attach anchor head coupled to the distal end of the length of line and configured with an engagement mechanism for anchoring to a door and frame, or other structural member, as an attachment point at a point of ingress or egress within a structure; and (g) a beacon assembly, on the multi-attach anchor head, configured for outputting a light pattern to facilitate user locating of the attachment point within the structure.

The present invention provides a number of beneficial elements which can be implemented either separately or in any desired combination without departing from the present teachings.

An element of the invention is a self-contained retractable horizontal tether line for use in fire fighting and rescue operations.

Another element of the invention is a tether line apparatus which is light weight, compact, and provides for one handed attachment and hands-free utilization.

Another element of the invention is a horizontal tether line apparatus having a multi-attach anchor head configured for anchoring to a structure in a number of different ways, including push and turn locking between a door and a door frame, connection to itself in a loop configuration, grasping a structural member, retaining a "mother-line" or other line, and so forth.

Another element of the invention is a horizontal tether line apparatus having a small line width, such as 4 mm.

Another element of the invention is a horizontal tether line apparatus which incorporates a reflective line, and/or a line that emits light, allowing the tracer line to be more readily seen in low visibility environments.

Another element of the invention is a horizontal tether line apparatus incorporating a line which is tolerant to high temperatures, such as up to 900 degrees Fahrenheit.

Another element of the invention is a horizontal tether line apparatus incorporating a line which is highly corrosion resistant.

Another element of the invention is a horizontal tether line apparatus which readily attaches to a waist belt (or similar strap), self-contained breathing apparatus (SCBA) and/or other attach point.

Another element of the invention is a horizontal tether line apparatus which includes an automatic debris-guard mechanism, preferably comprising multiple stages, which prevents liquid and/or solid debris from being retracted into the tether line housing.

Another element of the invention is a horizontal tether line apparatus having a separable tether line spool which can be readily removed from the tether line housing to effect replacement.

Another element of the invention is a horizontal tether line apparatus which is configured for accepting a variety of line lengths and types.

Another element of the invention is a horizontal tether line apparatus in which an intermittent lighted beacon is activated automatically on the multi-attach anchor head in response to its extension from the tracer line housing.

Another element of the invention is a horizontal tether line apparatus which can be extended by daisy-chain linkage to interconnect multiple additional tether line units to one another for extending the search area.

Another element of the invention is a horizontal tether line apparatus which is configured for hierarchical connection, such as connecting a plurality of tether lines to a "mother-line" deployed through an access corridor.

Another element of the invention is a horizontal tether line apparatus with robust multi-element indicator which provides status and line feed indications.

Another element of the invention is a belt latching clip which assures that the tether line housing is secure to the belt of the user.

Another element of the invention is doubly secure connection of the belt latching clip with a nested first and second retention structure.

Another element of the invention is an alternative multi-attach anchor head which is configured for anchoring about door hinges, door handles, and other structures.

Still another element of the invention is a horizontal tether line apparatus incorporating electronic tracking, such as in response to status and/or GPS positioning.

Further elements of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 15. It will be appreciated that the apparatus may vary as to configuration and as to details of the parts, and that the method may vary as to the specific steps and sequence, without departing from the basic concepts as disclosed herein.

1. Tracer Line Structures

The Tracer Line device described herein is preferably implemented within a compact and lightweight housing so that it may be easily carried by fire crews and other emergency and rescue personnel. A multi-attach anchor head is extendable on a line from the housing for quick and secure attachment to structural building features, such as the door hinge gap (space between door and door jamb or frame), grasping a building structural element in the anchor head, or by wrapping the tracer line around an anchor point structure and securing it, to assure that the user is guided back by the line to their point of entry (ingress) regardless of impairments to visibility (e.g., smoke, soot, steam, or spray). The housing is configured for housing the reel assembly, retraction drive mechanism, retraction braking mechanism, electronics, and removable receiving the multi-attach anchor head. The unit readily and securely attaches to the rescue worker, such as to a waist belt, yet still allows the user to quickly disconnect the unit in the event of entanglement or egress issues.

Figure 1:
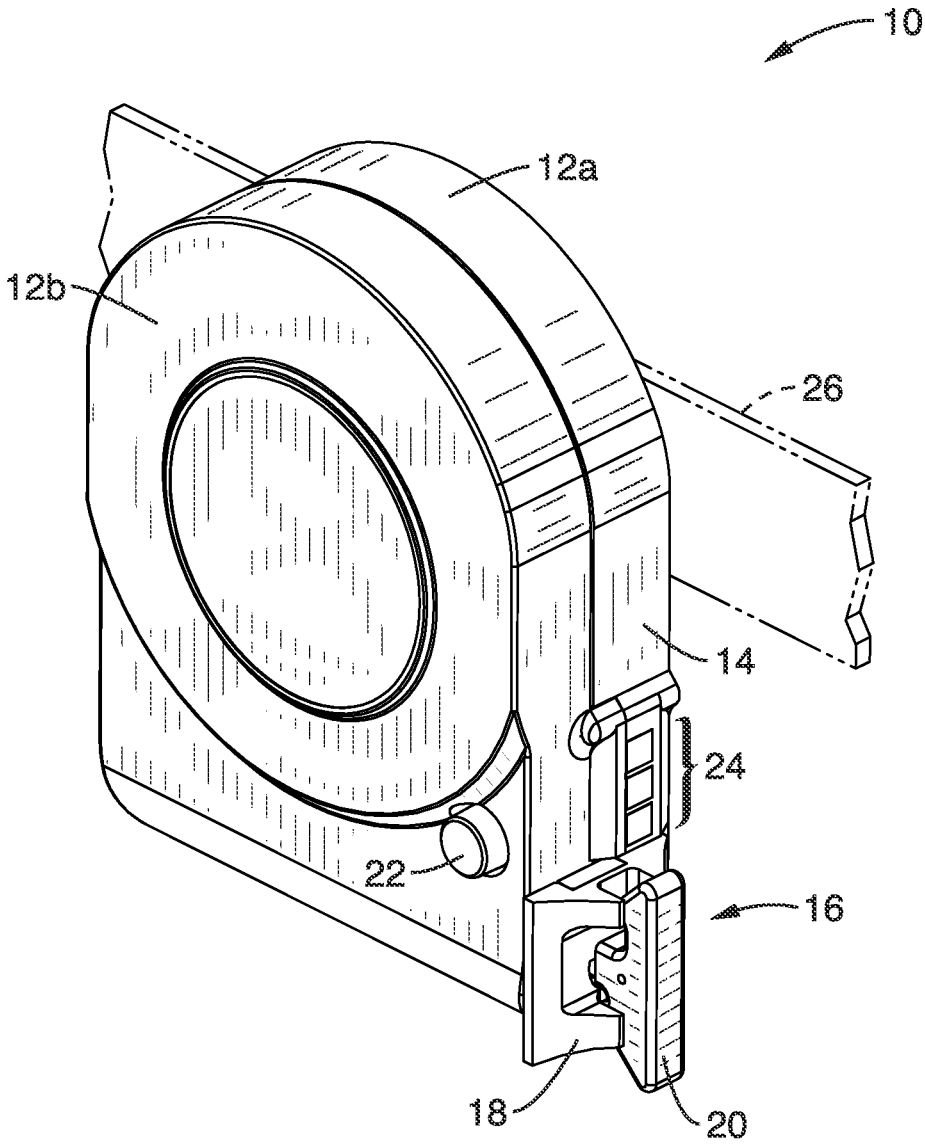
FIG. 1 is a perspective view of a tracer line according to at least one embodiment of the present invention, shown with a retracted anchor head.
Figure 2:
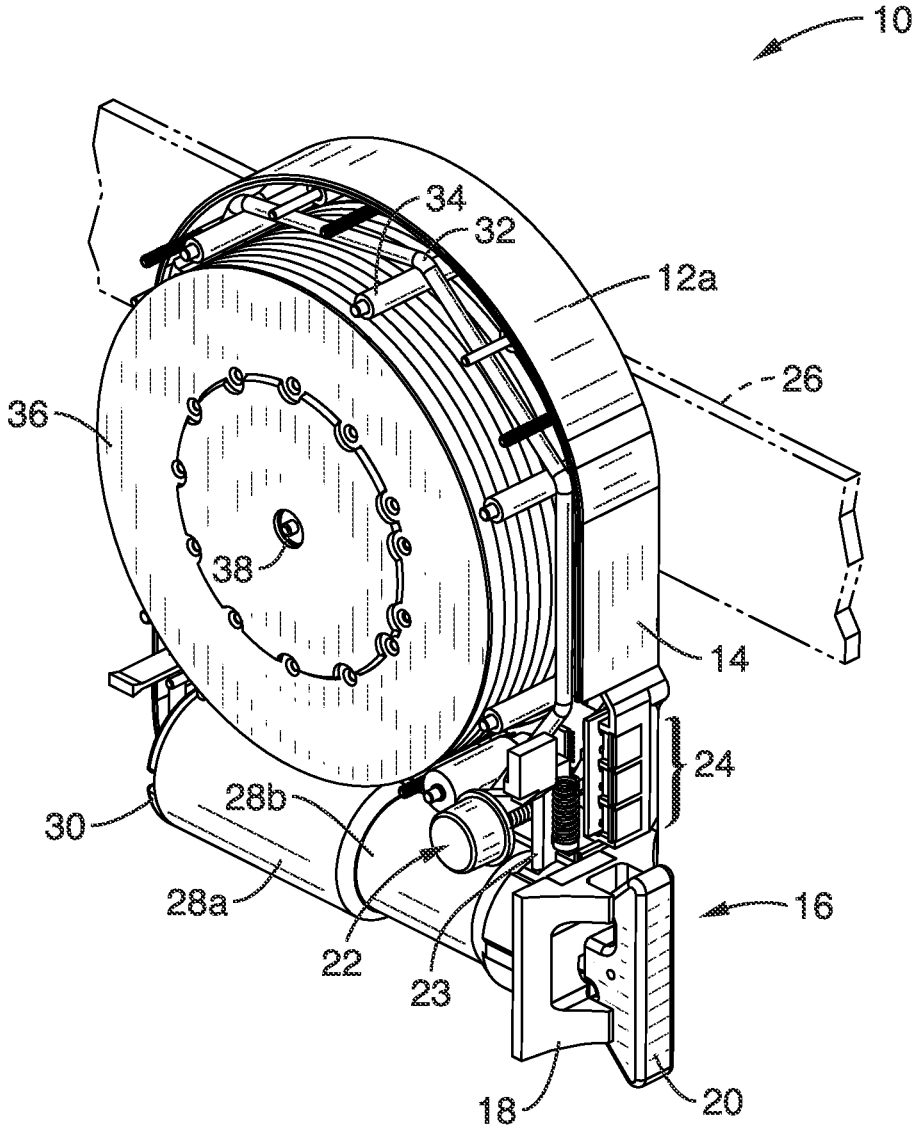
FIG. 2 is a perspective view of a tracer line according to at least one embodiment of the present invention, shown in a retracted position with the cover portion of the housing removed.
Figure 3:
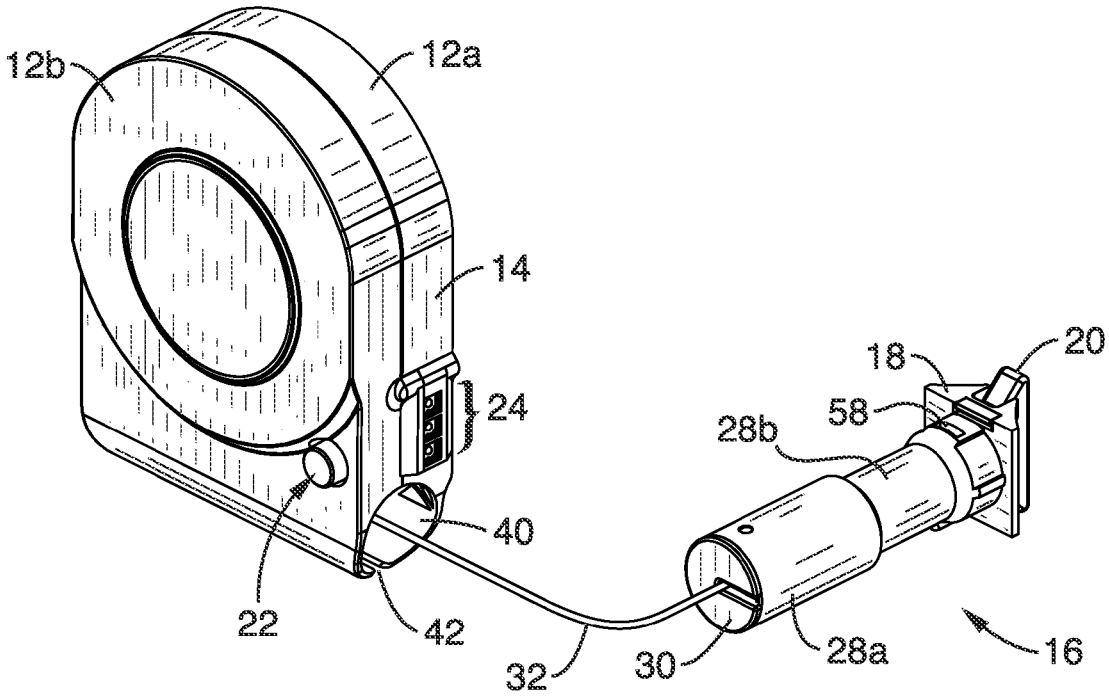
FIG. 3 is a perspective view of a tracer line according to at least one embodiment of the present invention, shown with the multi-attach anchor head and line partially extended.

FIG. 1 through FIG. 3 illustrate by way of example an embodiment of the tracer line apparatus 10. In at least one implementation, the tracer line device is approximately six inches square by about two inches in thickness.

The tracer line device has a housing comprising a first (rear) housing portion 12*a*, and a second (front) housing portion 12*b*. Extending from the front facing edge 14 of the unit is the end of a multi-attach anchor head 16 having nosepiece 18 with pivoting chock 20. Multi-attach anchor head 16 is attached by a high-tensile strength flexible line 32, as seen in FIG. 2 and FIG. 3, to a reel within the housing. A release button 22 is pressed to disengage catch 23 in FIG. 2 to release the multi-attach anchor head from the housing so that it may be extended. Tracer line housing (12*a*, 12*b*) is configured for attachment to the rescue worker (e.g., fire fighter, USART, or other rescue personnel), such as by connection to a strap 26 which is part of a belt, harness or similar personal gear of the rescue worker.

A multi-element indicator 24 is shown for indicating tracer line conditions, including the extent to which the line has been extended, as well as status conditions. The present invention contemplates the difficulty involved in reading conventional displays in a rescue environment where water, smoke, soot, debris and even flames, make discerning a readout which displays digits impractical. To overcome this problem, the present invention utilizes separate and distinct light sources to display a simple pattern which can be correctly recognized despite obscurations of smoke, water and soot.

One aspect of the multi-element indicator displays line play out conditions, such as the amount of line extended and/or an approaching line length limit. In one implementation, the multi-element indicator light 24 illuminates in a given sequence in response to every fixed amount of line which is extended (e.g., every ten feet) into the search area. Therefore, the multi-element indicator 24 registers the amount of line that has been deployed from the housing unit, and at set threshold conditions displays indications to the user which is readily discerned. For example in one implementation of the invention, the distance of line extension is indicated by the state of a first color of light emitted by the multi-element indicator light as follows: 1 steady light=10 feet, 2 steady lights=20 feet, 3 steady lights=30 feet, 1 blinking light=40 feet, 2 blinking lights=50 feet and 3 blinking lights=60 feet. In this way the user can quickly recognize when they are nearing the end of their tethered distance and may plan accordingly. In an alternative embodiment the multi-element indicator light indicates the amount of line remaining within the housing.

Other colors generated from the multi-element indicator are utilized in certain embodiments to convey additional information, such as status information. The multi-element indicator, as described, provides a number of benefits over using a counting device (e.g., mechanical, electro-mechanical, or electronic sensing counter) having a conventional readout, although these may be utilized in alternative implementations of the device. By way of example a photodetector or Hall-effect sensor may be utilized for detecting angular motion of one of the rollers, or other element which rotates in response to extension of the line. Programming executing on a microprocessor within the device computes relative line length played out and which is remaining, from which status indications are generated, such as determining the pattern to generate on the discrete indicators.

In FIG. 2 housing portion 12*b* is shown removed, and a handle 28*a* is shown slidably retained on a body portion 28*b*, with light beacon 30 seen as part of multi-attach anchor head 16. In the figure, the retention of line 32 can be seen on reel 36 which has a drive pin connection 38. By way of example and not limitation, the line used in this implementation of the invention comprises approximately sixty (60) feet of line having a cross section of approximately four millimeters (4 mm). This line preferably comprises a non-conductive material (e.g., reinforced synthetic line), although metallic cables, or other line types may be utilized. In a preferred embodiment, the line is corrosion resistant (e.g., water and preferably to common solvents) and configured for a thermal heat resistance which exceeds 900 degrees, while it provides high tensile strength. It should be appreciated that different implementations of the tracer line can be configured for different applications, such as utilizing different line strengths, lengths and characteristics.

Reel 36 is retained in the housing for allowing the tether line to be easily extended or retracted from the housing. In at least one embodiment, the entire spool may be removed from the housing to expedite replacement. It will be appreciated that line 32 is routed about the exterior of a plurality of rollers 34 (e.g., 6-8 rollers), preferably disposed between the reel and the interior of the housing, which interoperate with the reel retraction gearing to control feeding of the line from the spool and its proper retraction, while providing some drag to limit line speeds. In addition, the rollers are configured about the housing to allow the reel and its attached line to be removed from the housing as a single unit, with line sliding from about the exterior of the rollers as the reel is removed from housing portion 12*a*.

The multi-attach anchor head 16 is visible in FIG. 3, shown partially extended from a retraction opening 40 exposing a cylindrical body 28*b* over which is disposed handle 28*a* terminating with a light beacon 30 and connected upon tether line 32.

The inventive tracer line apparatus is configured for use with cooperative buddy-chaining, in which the multi-attach anchor head of a first rescue worker is attached to a first structural member, while the multi-attach anchor head of a second rescue worker can be inserted and engaged into the retraction opening 40 of the first rescue worker with the line extending therefrom. In this way the rescue line can be extended to any number of workers for supporting cooperative operations and search efforts covering an extended range.

A line slot 42 is configured along the length of the housing for displacing tether line 32 as another multi-attach anchor head is inserted into retraction opening 40 and engaged by a retention latch, thereby the line extending from the unit itself does not interfere with insertion of a multi-attach anchor head from another unit. In at least one embodiment, the housing is configured to allow the tracer line to be extended from either the front side of the housing as shown in FIG. 3, or alternatively from the rear side, such as in response to guiding said line through line slot 42 and optionally including one or more slidable bearing surfaces and/or roller. For example, this allows a user to secure the anchor in front of them, while allowing the line to extend as they walk away from the anchor, such as with their back turned toward it.

Figure 4:
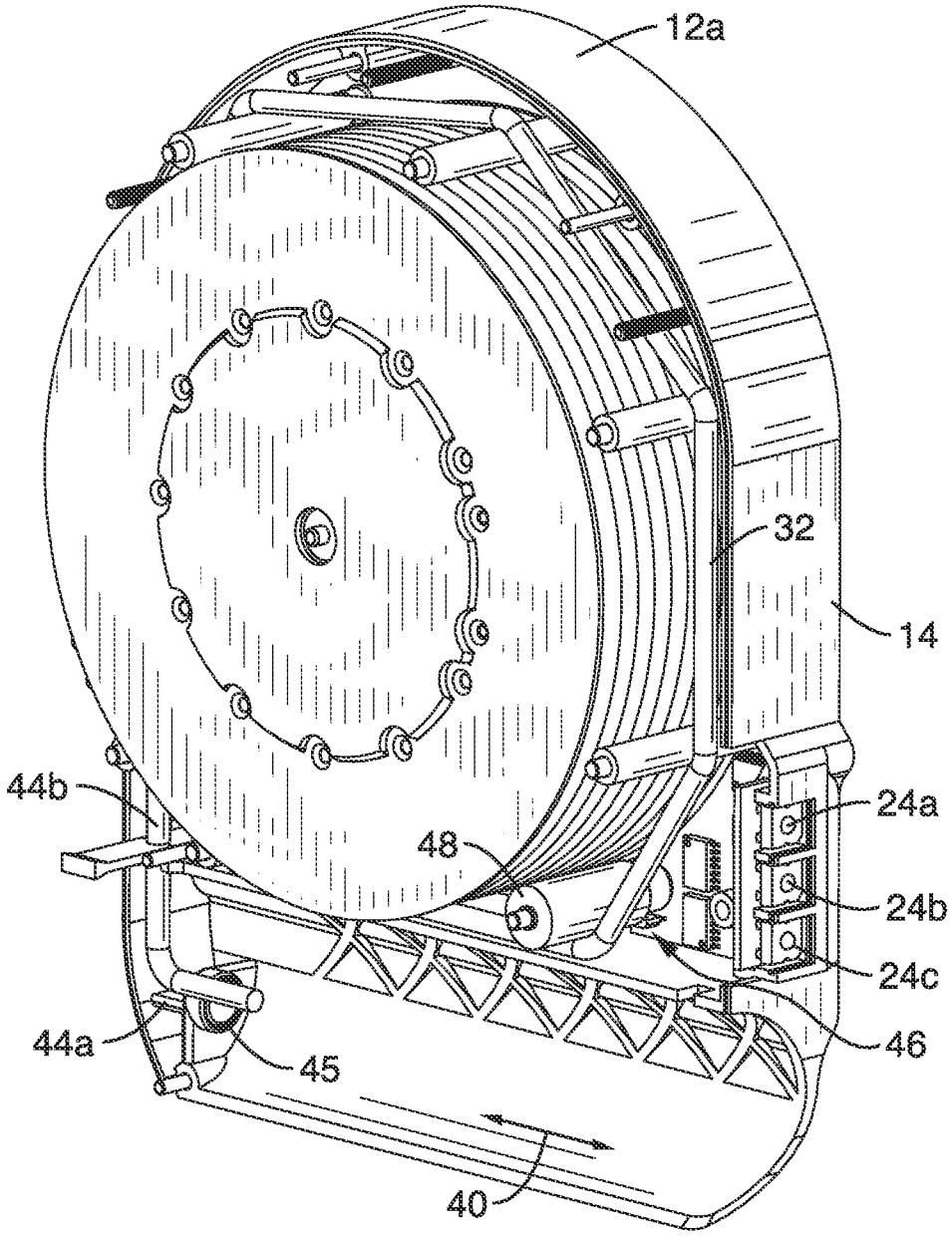
FIG. 4 is a partially exploded view of a tracer line according to at least one embodiment of the present invention, showing a portion of the housing configured for receiving the multi-attach anchor head.

FIG. 4 illustrates another view of the tracer line device with both the front housing 12*b*, as well as the multi-attach anchor head 16, removed to view additional portions of the device. To prevent introducing soot, water, or other materials into the tether line apparatus, a multistage debris guard has been incorporated to remove material from the line as it is being retracted. The line enters a first bearing wiping zone 44*a* which bends the cable and forces large materials and liquids from the lines, and then passes through a second wiping zone 44*b*, such as preferably a set of compliant wipers, which removes residual materials from the line. By assuring that the line is clean upon entering the spool, the line and housing are less subject to corrosive influences, as well as fouling of the rollers, and other mechanical elements. It should be appreciated that the multistage debris guard can be implemented with different structures, such as any combination of elements which brush along the sides of the line as it is being retracted. These structures are preferably configured in at least two stages to assure that debris is not brought into the housing as the line is retracted. In addition, the first stage is preferably configured to direct liquids to fall into the slotted retraction opening whereby they exit the housing.

A magnet 45 is shown in the tracer line housing 12*a* for controlling the activation of the light beacon on the anchor head. The anchor head contains a magnetically actuated switch, such as a reed-switch, which opens to an OFF state in response to attaining close proximity with the high level of magnetic field from magnet 45. It should be appreciated that the magnetic field intensity of magnet 45 is significantly higher than one would encounter from the slight magnetizations of steel building structure elements. Upon releasing and moving the anchor head from the housing, the light beacon activates automatically, in response to the reed switch changing state as the magnetic field intensity drops (e.g., after approximately one inch of travel).

A line extension registration means is depicted in FIG. 4 in response to a sensor 46 configured for detecting the rotation of roller 48. By way of example and not limitation, sensor 46 can be configured to detect mechanical, magnetic or optical changes as the exterior of roller 48 passes by sensor 46. For example, roller 48 may contain structures which can be optically registered (e.g., alternating diffuse and reflective surfaces) or magnetic regions (e.g., alternating magnetic field orientations) whose proximity is sensed using a Hall-effect sensor or similar.

Figure 5A:
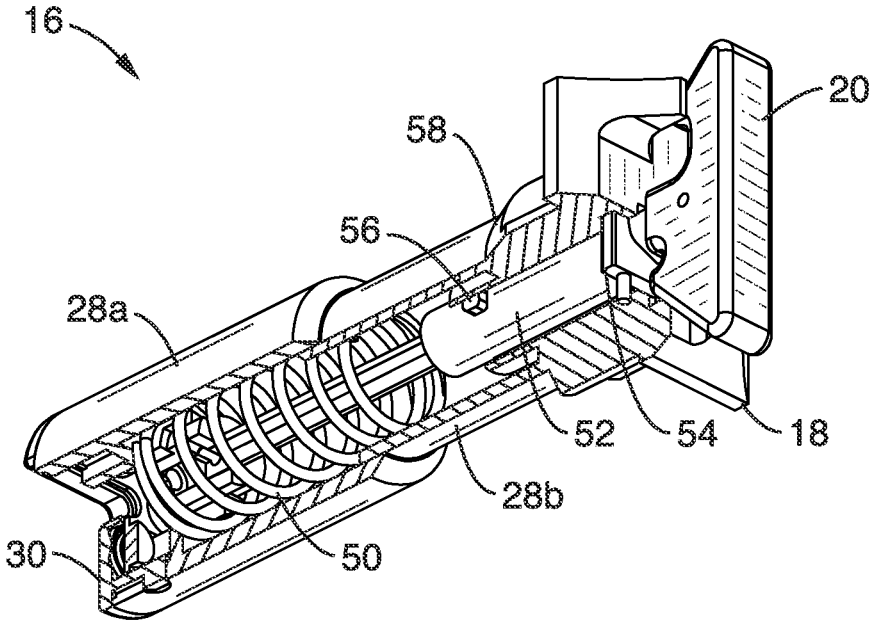
FIG. 5A-5B are perspective views of the multi-attach anchor head according to at least one embodiment of the present invention, shown in a normal position and with the chock portion extended.
Figure 5B:
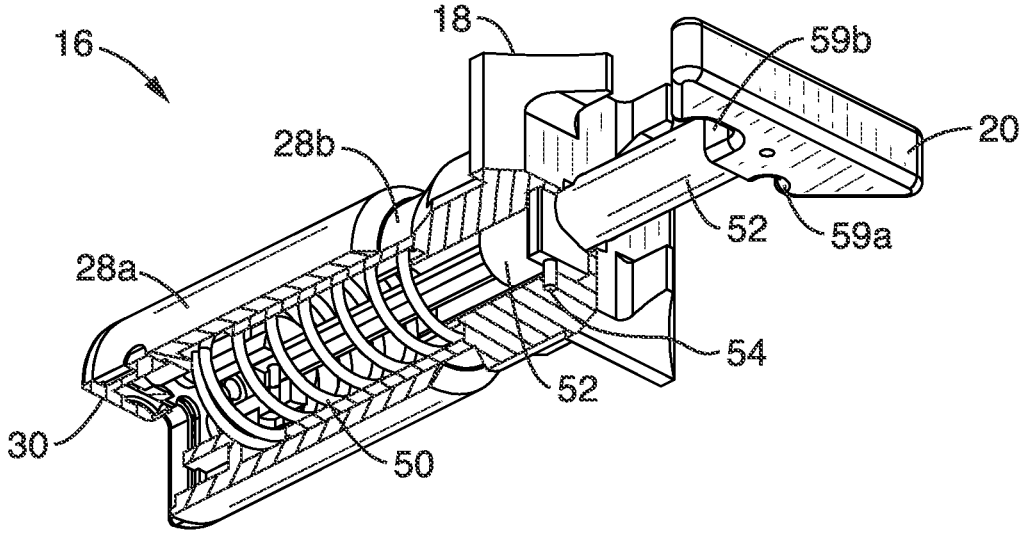

FIG. 5A-5B illustrate an example embodiment of the multi-attach anchor head 16, shown without the line installed. In FIG. 5A handle 28*a* is shown slidably engaged over a body portion 28*b* which houses a spring 50 and elongate rod 52 attached between the proximal end of handle 28*a* and nosepiece 18. Also shown are elements of an engagement mechanism with an extension lock 54 and a key 56, on elongate rod 52, which is configured for sliding into a keyway in nosepiece 18. It should be noted that pivoting chock 20 terminates elongate rod 50 which is attached to handle 28*a*.

In FIG. 5B the anchor head is shown in a deployed and locked position which arises in response to a single handed push and turn of handle 28*a*. In response to pushing handle 28*a* in the direction of pivoting chock 20, spring 50 is compressed, which causes elongate rod 52 terminating in pivoting chock 20 to extend out from nosepiece 18. As the handle is rotated, the pivoting chock 20 rotates to a transverse position in relation to nosepiece 18.

In the retracted position, as seen in FIG. 5A, chock 20 driven by handle 28*a* cannot rotate in relation to nosepiece 18. The key 56 on elongate rod 52 is aligned with the opening in extension lock 54 which allows full travel of handle 28*a* over body portion 28*b* compressing spring 50. Upon extension, key 56 slides in an first keyway in nosepiece 18, while an opening in the extension lock 54 allows rotation of the handle 28*a* and its attached elongate rod 52 with chock 20. Rotation of handle 28*a*, and thus elongate rod 52, moves extension lock 54 out of the way. Upon release of handle 28*a*, the extension lock 54 engages to set the anchor in a locked position which prevents re-extension of the chock and locks out rotation as seen in FIG. 5B. In this way the anchor is made secure so that any tension applied to the anchor from the line does not compress the spring, nor allow rotation of chock 20, maintaining a secure anchor connection.

It will be appreciated that the head of chock 20 is preferably configured with different engagement structures 59*a*, 59*b*, for anchoring the head to a variety of different building structures. For example, a first side 59*a* is shown with a small slot or channel for engaging the line of this tracer line another tracer line, a mother-line (without damaging the line) or to any small scale structural element. A second side 59*b* is shown having a large catch opening for facilitating engagement on large structural surfaces or current 9 mm search lines already in service today as used under current standard operating practices.

In storing multi-attach anchor head 16 within the housing as seen in FIG. 1, spring 50 is slightly compressed with handle

28*a* sliding over body portion 28*b*, whereby a head latching structure 58 is engaged by catch 23 as seen in FIG. 2. Head latching structure 58 is shown in FIG. 3 and FIG. 5A on a surface of body 28*b*, comprising a recess, although it may alternatively comprise any mechanically engageable structure, to which the multi-attach anchor head can be latched into the housing to assure retention thereof. Accordingly, the multi-attach anchor head becomes securely engaged in the housing and does not rattle or induce wear on engagement surfaces, while simultaneously the beacon light is deactivated as the anchor head is received within the housing.

When a member of a fire crew, or Urban Search and Rescue Team (USART), or any rescue worker utilizing the present invention, enters a room, the multi-attach anchor head 16 can be readily, and single-handedly, inserted between the door and one side of the door jamb. It will be recognized that the term "door jamb" refers to either of the two sidepieces of a doorframe. Although, the anchor head of the present invention can be attached along any portion of the door, preferred security and operational benefits are usually obtained by inserting it between the door and that portion of the door frame (door jamb) at which the hinges secure the door to the door frame. In one mode the user grasps the handle of the multi-attach anchor head and shoves it into the gap thus extending chock 20 between the door and door jamb, with nosepiece 18 retained on the opposing side. With a quick turn of the handle the pivoting chock 20 is engages the door structure and locks, thus creating a secure anchor. The handle is released and the individual can now move through the room tethered back to this secure anchor at the doorway, which is also their most logical point of egress. Insertion of the chock between the door and door frame on the hinge side also provides the very significant benefit of retaining the door in an open position, thus facilitating ventilation, visual identification, as well as ingress and egress.

The multi-attach anchor head, as its name implies, also provides multiple modes of attachment. For example it can form a clamping action on many solid structures or be made secure to itself after wrapping around an anchor point, such as outside the search entry point, in response to the spring action of the pivoting lock structure. In addition, the pivot lock element operates as a means for tie-off, for engaging the tether line of this tracer line unit or another tracer line unit. The multi-attach anchor head is further configured for attaching by means of hierarchical connection to other users, and/or to a master line, herein referred to as a "mother-ship line", from which a number of users may connect. In this application the mother-ship line is configured for attachment between two points, and may be of a larger diameter and/or length of line. For example, the mother-ship line may be deployed down a hallway from which a number of rooms extend, thus allowing personnel to tie off from the mother ship line.

To aid fire fighting personnel in readily identifying the point of ingress (entering the room), even under smoky conditions, the apparatus incorporates a beacon light 30 on the proximal end of the multi-attach anchor head 16. Light is preferably generated by one or more high-intensity LEDs, or other lighting elements, within the beacon device which are seen through an outer lens which seals the beacon and its electronics from water, debris, smoke and other environmental material. Beacon 30 is preferably configured for blinking in one or more colors so that it may be readily seen by the fire fighter. In one mode of the invention, the units are implemented to have different blink patterns (including color pattern sequence) so that beacons can be readily discerned from one another. In one optional implementation, the pattern of beacon blinking and/or its color combinations are used to alert other personnel of the distance the wearer of the inventive tracer line device is extended from the anchor into the search area. Implementation of this feature requires implementation of anchor head-to-housing communication over the line or by way of wireless communication to communicate detected line extension information to the anchor head. The beacon is water tight and in one implementation is configured as a disposable element, with a battery failure warning light to signal the user when expected battery life falls below a desire threshold, indicating that the battery should be replaced. The light and its power source can be replaced in a single operation to assure that sufficient operating power is available each time the tracer line is utilized.

In at least one implementation, the beacon light is automatically activated in response to deploying the tether line by extending the multi-attach anchor head from the housing. Sensing of tether line deployment can be performed in response to the state of one or more mechanical switch sensors, magnetic sensors, optical sensors or other means of sensing upon which the beacon is activated. For example magnetic sensing can be utilized to change switch state in response to proximity from a magnet within the housing, or in response to change of state of a mechanical switch. Power switching is preferably utilized in a preferred embodiment to break circuit power to the beacon when the multi-attach anchor head is received in the housing, whereby no power draw arises from the associated battery unless the tether line is deployed.

For example, this switching can be readily implemented with a normally-closed single-pole, single-throw (NC SPST) mechanical switch on the multi-attach anchor head (seen in FIG. 14) which closes, in response to the anchor head being removed from the housing, to complete the circuit and activate the beacon. Similarly, magnet 45 in the tether line housing described in FIG. 4 can be used to retain a reed-switch in the anchor head in an open position (OFF), whereby upon removal from the housing, the reed switch returns to its normal closed position (ON) to complete the circuit and activate the beacon. It will be appreciated that other mechanisms for activating the beacon light in response to extension of the tether line may be utilized without departing from the teachings of the present invention.

Figure 6:
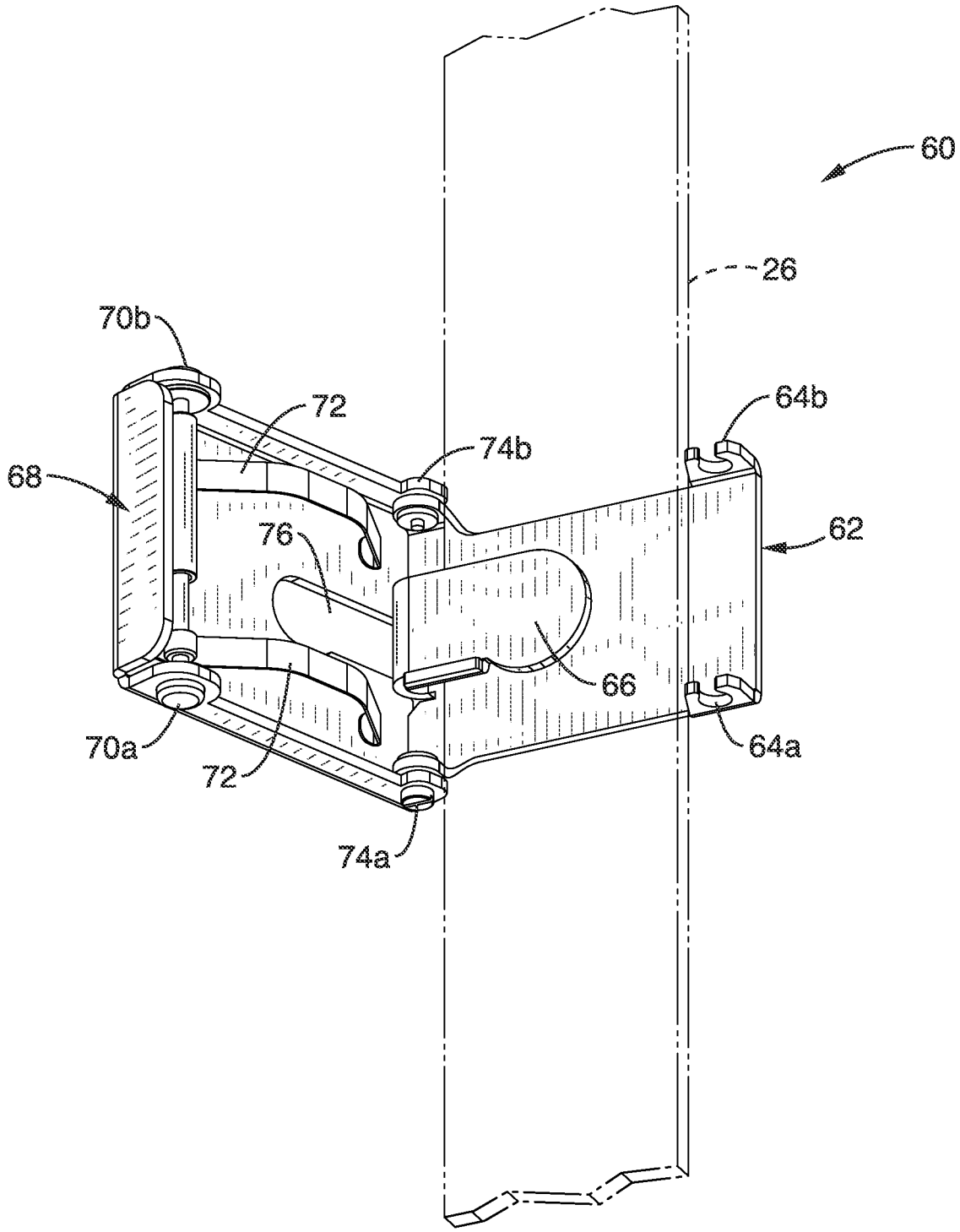
FIG. 6 is a perspective view of a belt clip attach mechanism according to at least one embodiment of the present invention, showing a rotatable locking attach mechanism.
Figure 7A:
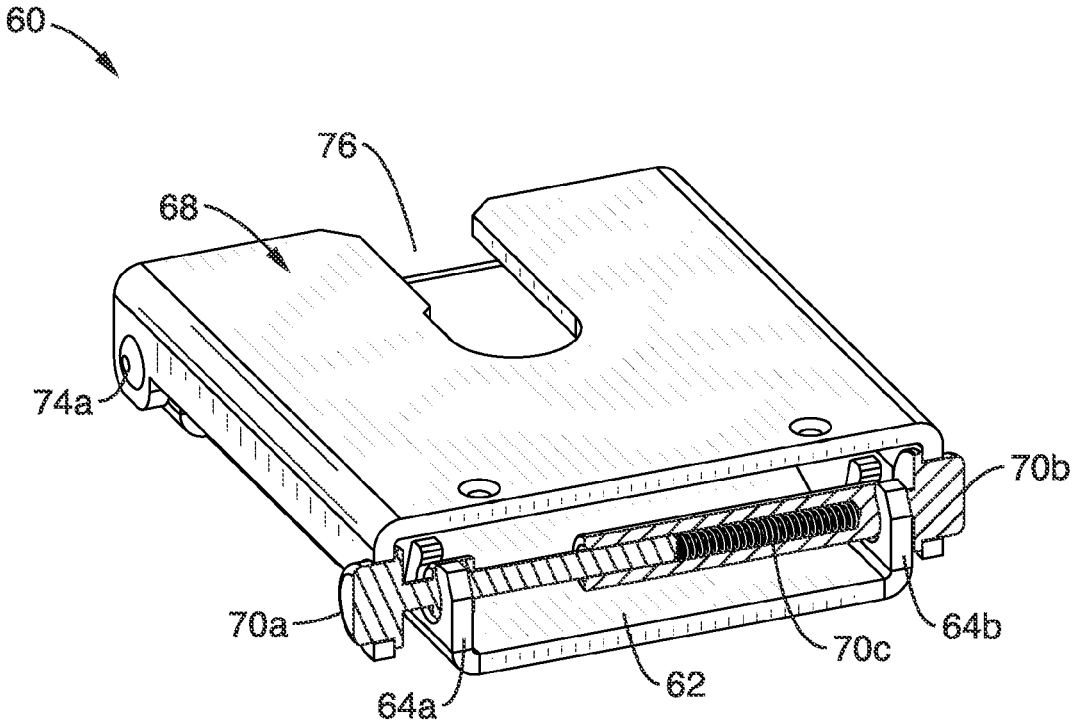
FIG. 7A-7B are perspective views of a belt clip attach mechanism according to at least one embodiment of the present invention, shown in a locked and unlocked configuration.
Figure 7B:
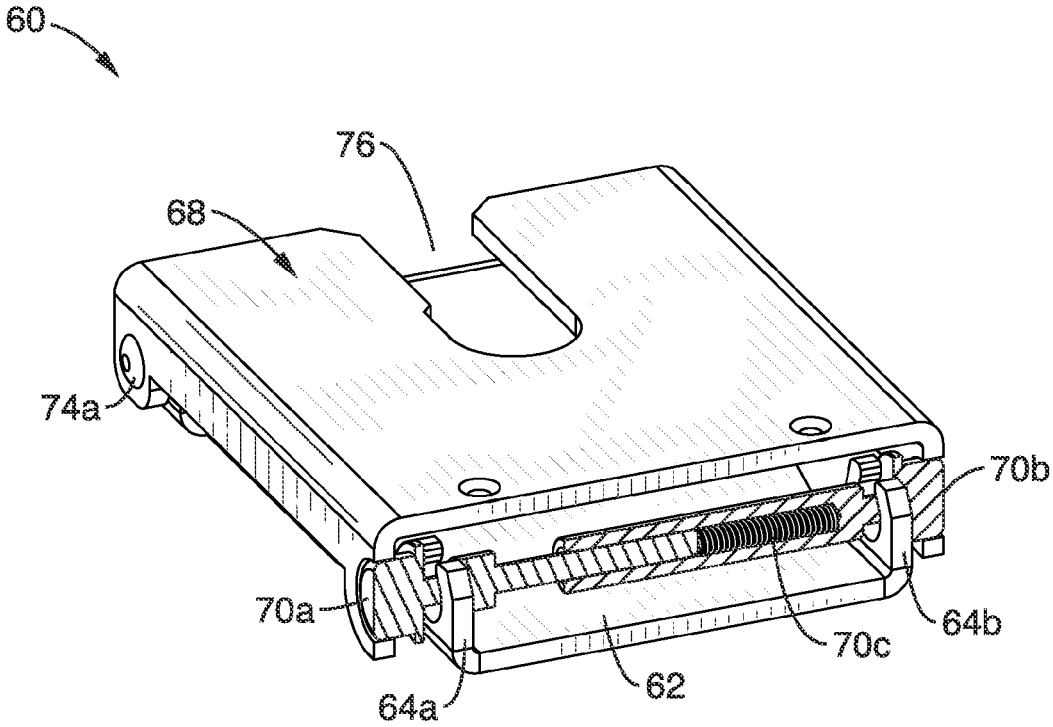

FIG. 6 and FIG. 7A-7B illustrate an example embodiment 60 of a dual retention clip structure. A first member 62, having engagement clips 64*a*, 64*b*, and second member 66 is disposed through pivots 74*a*, 74*b*, on base member 68 which is adapted for being secured to the tracer line housing by engagement structure 76. The second member 66 is disposed on first member 62 with sufficient spacing existing thereof for insertion of a strap 26, such as comprising a portion of the belt or other user gear to which the tracer line apparatus is to be retained. Optionally, second member 66 can be configured to apply a spring tension upon retained strap 26, such as in response to its bend geometry as it extends or is coupled to first member 62. Thus, strap 26 is first retained between second member 66 and first member 62, with engagement clips 64*a*, 64*b* preventing belt slippage out of the opening thereto.

The base member 68 is preferably configured with one or more optional securing arms 72 attached along a slidably engaged shaft coupling a first securing pin 70*a* and a second securing pin 70*b*, which are ends of a spring plunger element. The center portions of pins 70*a* and 70*b* preferably comprise nested cylinders of the spring plunger which slidably engage one another and are held apart by a spring component 70*c* as seen in FIG. 7A-7B.

Once strap 26 is engaged between first member 62 and second member 66, then the user applies pressure to the exterior of pins 70*a*, 70*b*, which compresses spring 70*c*. First member 62 is then rotated so that the opening in engagement clips 64 slides over a narrow portion on each of pins 70*a*, 70*b*. Upon release of pins 70*a*, 70*b*, a wider portion of these nested cylinders engages engagement structures 64*a*, 64*b*, to lock first member 62 to base member 68. It will be seen that once locked, securing arms 72 apply pressure to strap 26 to prevent the belt clip from sliding too easily along strap 26. It should also be appreciated that some form of compression retention on strap 26 is preferred, either by second member 66 compressively engaged with first member 62, and/or the use of other compressive members, such as securing arms 72.

It can be seen from the above that the dual retention clip structure 60 provides a first retention of the belt between first member 62 and second member 66, and then a second locking retention of the entirety of second member 66 with strap 26, between first member 62 which is locked to base member 68. An engagement structure 76 on clip structure 60 is configured for being coupled to the tracer line housing as described below.

Figure 8:
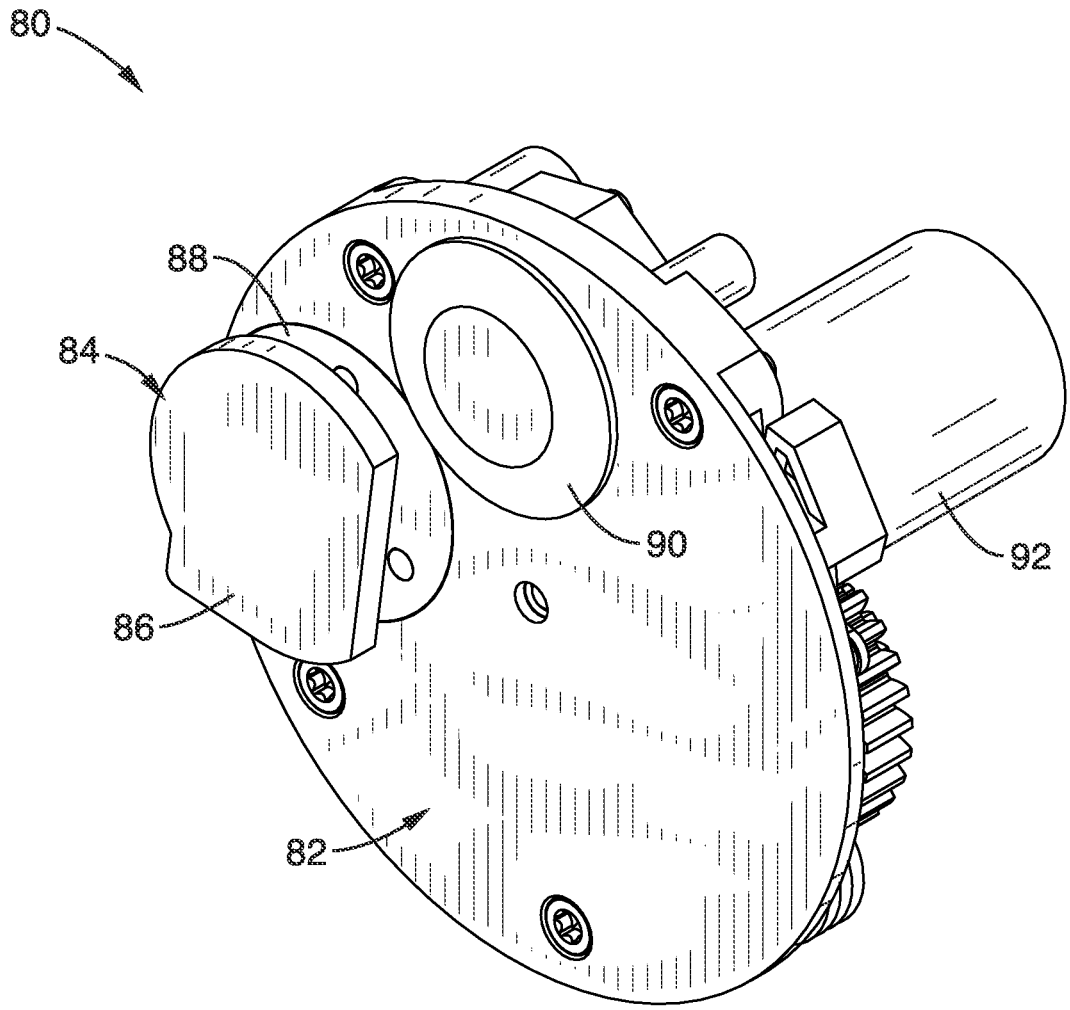
FIG. 8 is a perspective view of the power-spring gearing configured within at least one embodiment of the present invention, showing the exterior configured for engaging the belt attach mechanism.
Figure 9:
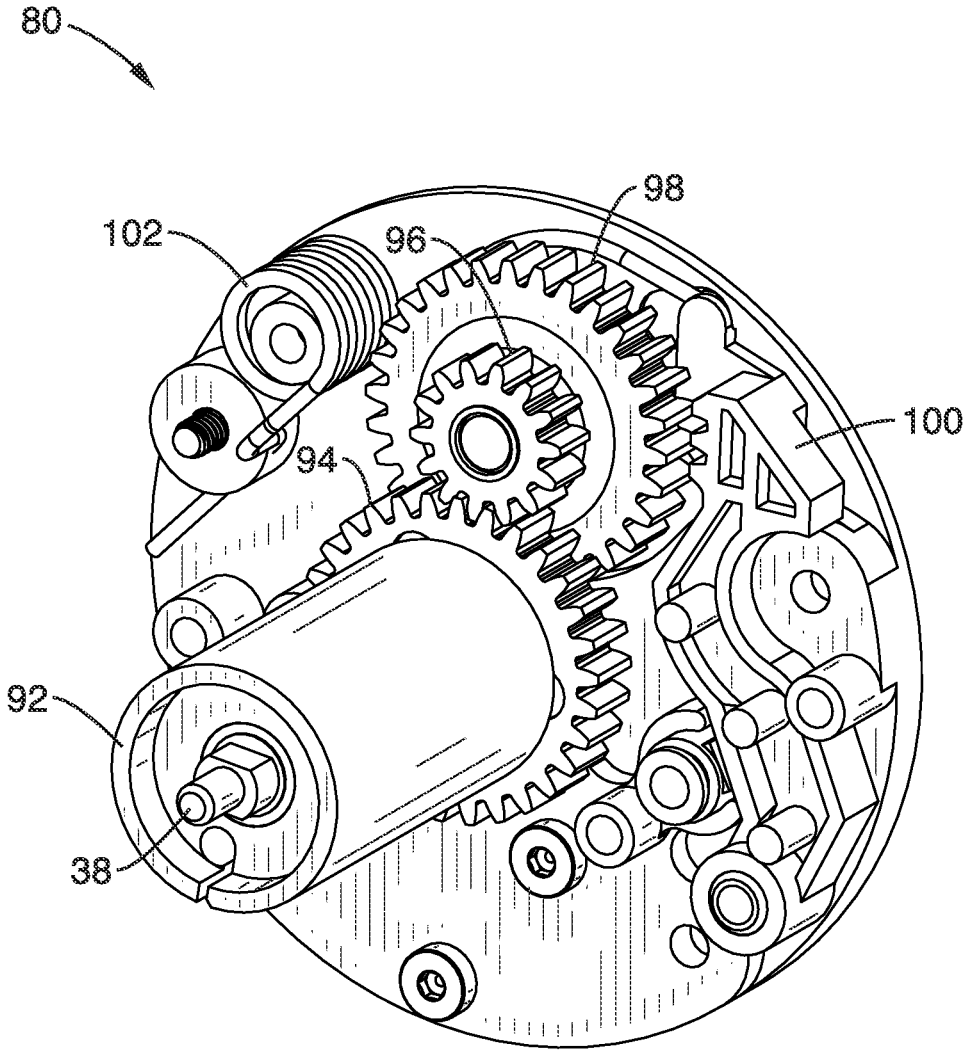
FIG. 9 is a perspective view of the power-spring gearing configured within at least one embodiment of the present invention, showing a portion of the mechanism for driving line retraction in response to power spring action.
Figure 10:
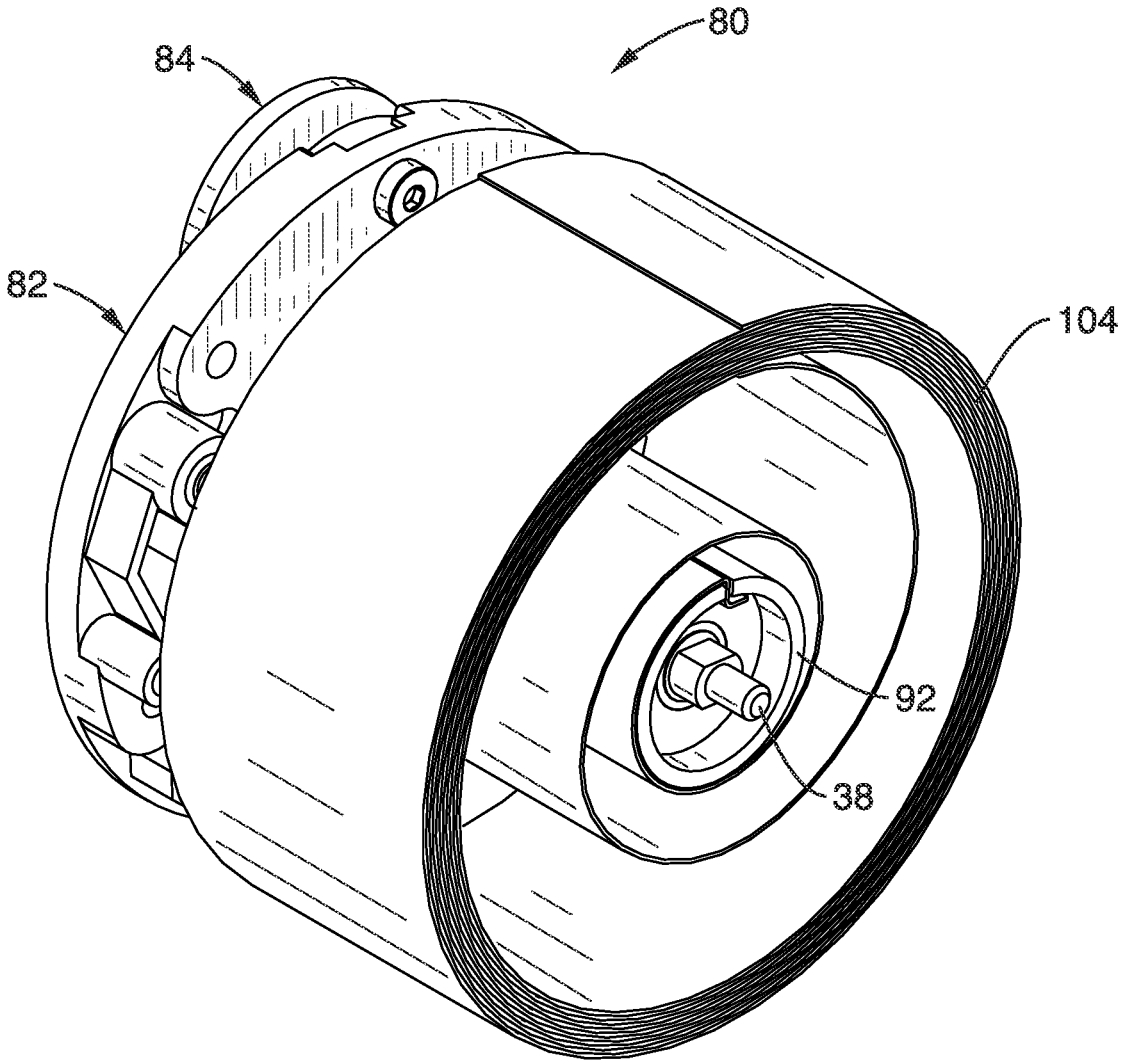
FIG. 10 is a perspective view of power-spring gearing configured within at least one embodiment of the present invention, showing the interior configured for driving line retraction in response to power spring action.

FIG. 8 through FIG. 10 illustrate an example embodiment 80 of a line retraction mechanism which is preferably disposed on the rear face of the tracer line device, retained within first housing portion 12*a*, and configured for being coupling to dual retention clip structure 60 and providing quick disengagement thereof. The retraction mechanism 80 is shown in FIG. 8 with an exterior face 82 from which extends a clip engagement structure 84, such as including a top surface 86 over a recessed engagement area 88.

A disconnect braking button 90 is shown that provides additional safety. When the tracer line housing is removed from belt clip 60, the pressure on button 90 is released, and the brake is engaged on the gearing, to stop line retraction and preventing the unit housing from retracting away from the user toward the place where the multi-attach anchor head is anchored. A arbor 92 is shown extending from exterior face 82 in a direction interior of the tracer line housing for connection to the rotating end of a wound power spring (104 of FIG. 10). A concentric drive pin connection 38 is shown passing through arbor 92 for driving the spool through concentric gearing.

In FIG. 9 a line retraction gearing mechanism is shown comprising a mechanism for gearing up a power spring drive through concentric gears to drive the spool through drive pin connection 38, which accordingly rotates a plurality of times for each rotation of the power spring. Accordingly, for each turn of arbor 92, drive pin connection 38 makes 5-10 rotations in response to operation of the gearing which includes 94, 96 98 and one gear beneath gear 94 which is coupled to drive pin connection 38. In operation, spring motion force is applied (as seen in FIG. 10) to arbor 92 which drives the gearing coupled to a concentric gear which drives pin connection 38 coupled to the spool. The gearing preferably provides a gearing ratio in the range of approximately 5:1 to 10:1, to increase the revolutions at the spool, so that the spool turns 5-10 revolutions for every turn of the arbor. The arbor 92 is attached to the inner end of the power spring (104 shown in FIG. 10) to drive the spool which rotates in response to the rotation of the drive pin connection (38 in FIG. 2). The concentric gearing arrangement beneficially provides a more constant take-off radius of the line and thus a more consistent retraction force. The center pin, and thus the spool, are driven according to the gear ratio, such as 5-10:1. Gearing of the spool allows the number of rotations of the spool to far exceed the number of rotations which can be supported by the wound spring, for example the spool in one configuration can provide approximately 55 spool rotations, while a power spring is limited to supporting approximately 10-15 turns. The gearing is shown comprising spur gears, however, it will be appreciated that planetary gearing and other forms of gear reduction can be utilized without departing from the teachings of the present invention.

A brake structure 100 is coupled to button 90 and biased with spring 102 toward engagement with the gearing. Therefore, unless button 90 is being actively depressed, brake 100 engages the gearing and prevents tracer line retraction or extension. In response to attachment of the tracer line housing to belt clip 60, button 90 is depressed (opposing the forces of spring 102) and brake 100 is moved out of engagement with the gears, whereby the tracer line can be extended or retracted as desired by the user.

In FIG. 10 a coiled spring tensioner (power spring) 104 is shown disposed on arbor 92 to apply a desired retraction force upon spool 36 (FIG. 2) and thus to line 32 disposed thereon. Power spring 104 supplies approximately 10 foot pounds of torque on the extended line at the middle of its extension range. The two opposing ends of the coiled spring are respectively configured for attachment to arbor 92 to a fixed sleeve attached to the housing.

It should be appreciated that characteristics of both line extension and retraction can be controlled in the tracer line device. A plurality of rollers 34 are disposed about the periphery of the housing (e.g., seven rollers) as shown in FIG. 2 to provide limited control of overly fast line extension speeds. It will be appreciated that alternative embodiments can be implemented by replacing one or more of these rollers with speed responsive mechanisms, such as a centrifugal clutch, or similar speed limiting mechanism, so as to further control line extension speed. For example, an embodiment can be implemented to provide sufficient line extension speed control to enable the device to support a fire fighter that has taken a fall or fallen through a weak floor.

Figure 11A:
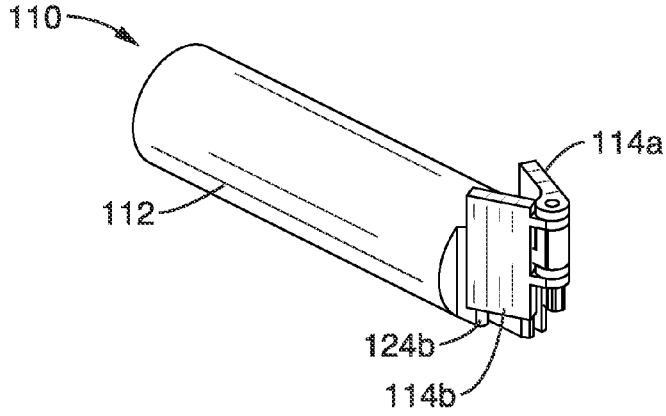
FIG. 11A-11C are perspective views of an alternative embodiment of the multi-attach anchor head according to at least one embodiment of the present invention, shown moving from a retracted position to an extended position.

FIG. 11A-11C, FIG. 12, and FIG. 13, illustrate an example embodiment 110 of an alternative multi-attach anchor head which can be anchored in a number of different ways, such as over a door hinge or between the door and door jamb as in the multi-attach anchor head already described. A body assembly 112 is shown with extendable engagement flaps 114*a*, 114*b* forming a wedge when in a retracted position as shown in FIG. 11A.

Figure 11B:
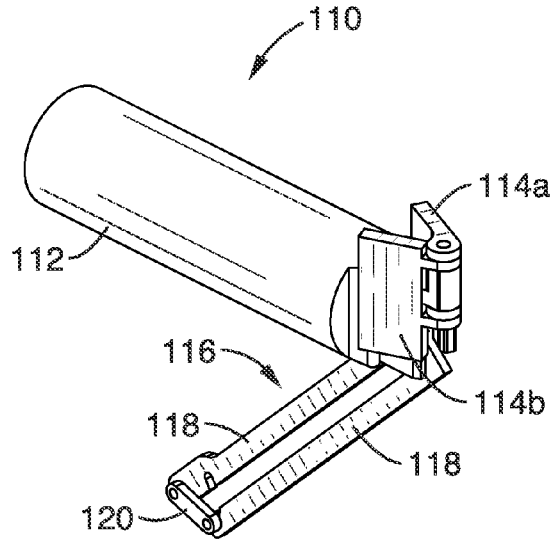
Figure 11C:
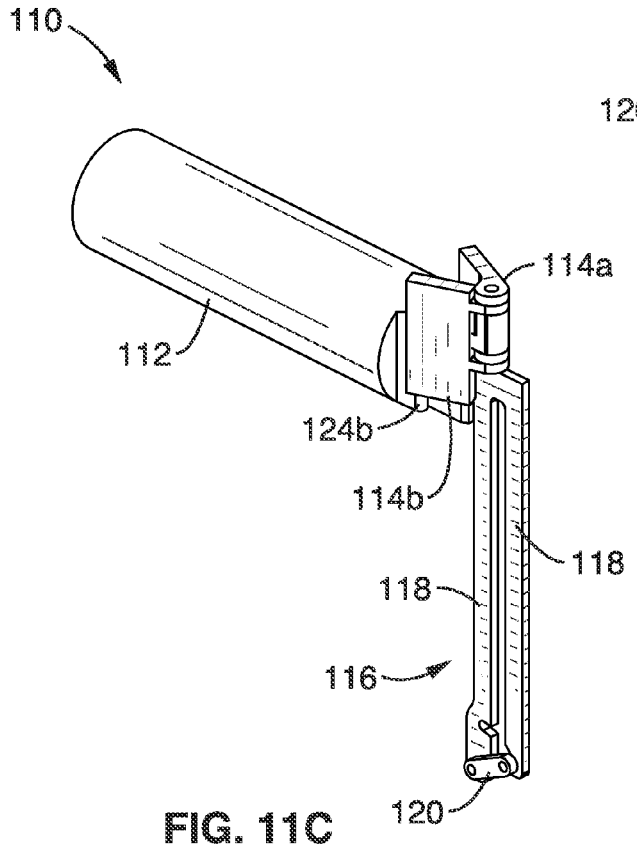

A substantially planar capture structure 116 is shown retracted into a capture recess (see capture recess 122 in FIG. 12) within the body assembly 112 of multi-attach anchor head 110 in FIG. 11A, partially extended in FIG. 11B and fully deployed in FIG. 11C. Planar capture structure 116 is configured for engaging structural members for anchoring the head, and is shown comprising a planar member 118 which defines (surrounds) a channel area into which a structural element is inserted through spring entry opening 120 (gate). In use, the capture structure extends to engage a hinge or other building structural element through the gate of spring entry opening 120 for anchoring the multi-attach anchor head. This alternative multi-attach anchor head allows similar door jamb engagement as provided by the anchor head already described.

Figure 12:
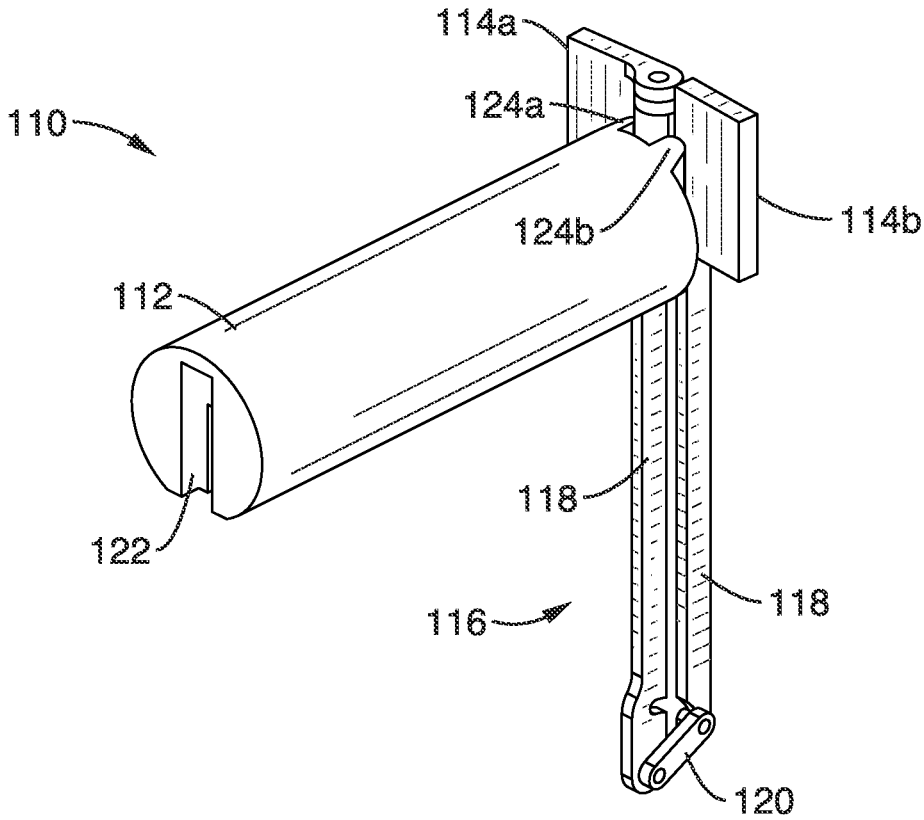
FIG. 12 is a perspective view of an alternative embodiment of the multi-attach anchor head according to at least one embodiment of the present invention, shown in an extended position.
Figure 13:
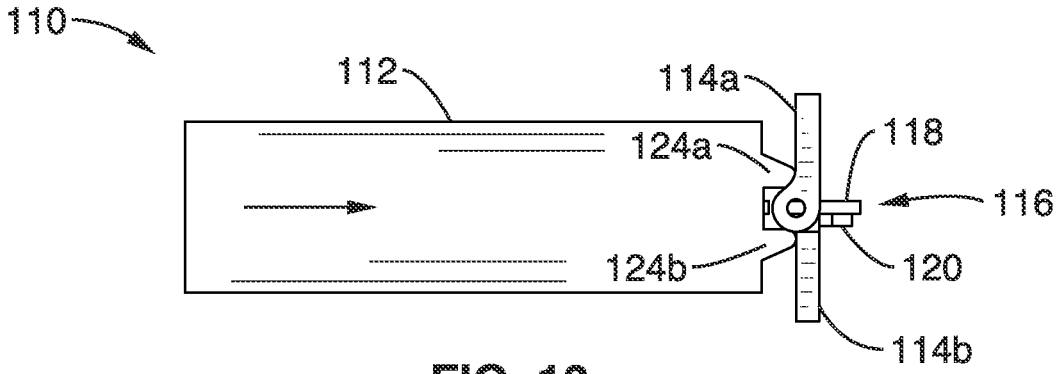
FIG. 13 is a top view of an alternative embodiment of the multi-attach anchor head according to at least one embodiment of the present invention, shown in an expanded position.

As an example of anchoring on a door, planar capture structure 116 is slid over a hinge on the opened door, then the engagement flaps 114*a*, 114*b* are deployed as seen in FIG. 12 in response to activation by a portion of body/handle assembly 112, such as cam surfaces 124*a*, 124*b*, so that flaps 114*a*, 114*b* extend to hold the door in a desired open position. It should be appreciated that the present invention is amenable to embodiment variations on the multi-attach anchor heads described, which may be combined with one another and what is known in the art without departing from the teachings of the present invention. For example, it will be appreciated that the anchor head described in FIG. 11A-13 can be implemented for anchoring to door handles, or other elements, while combination anchors can be implemented to attach to door frames or surrounding structures.

2. Electronic Components

Figure 14:
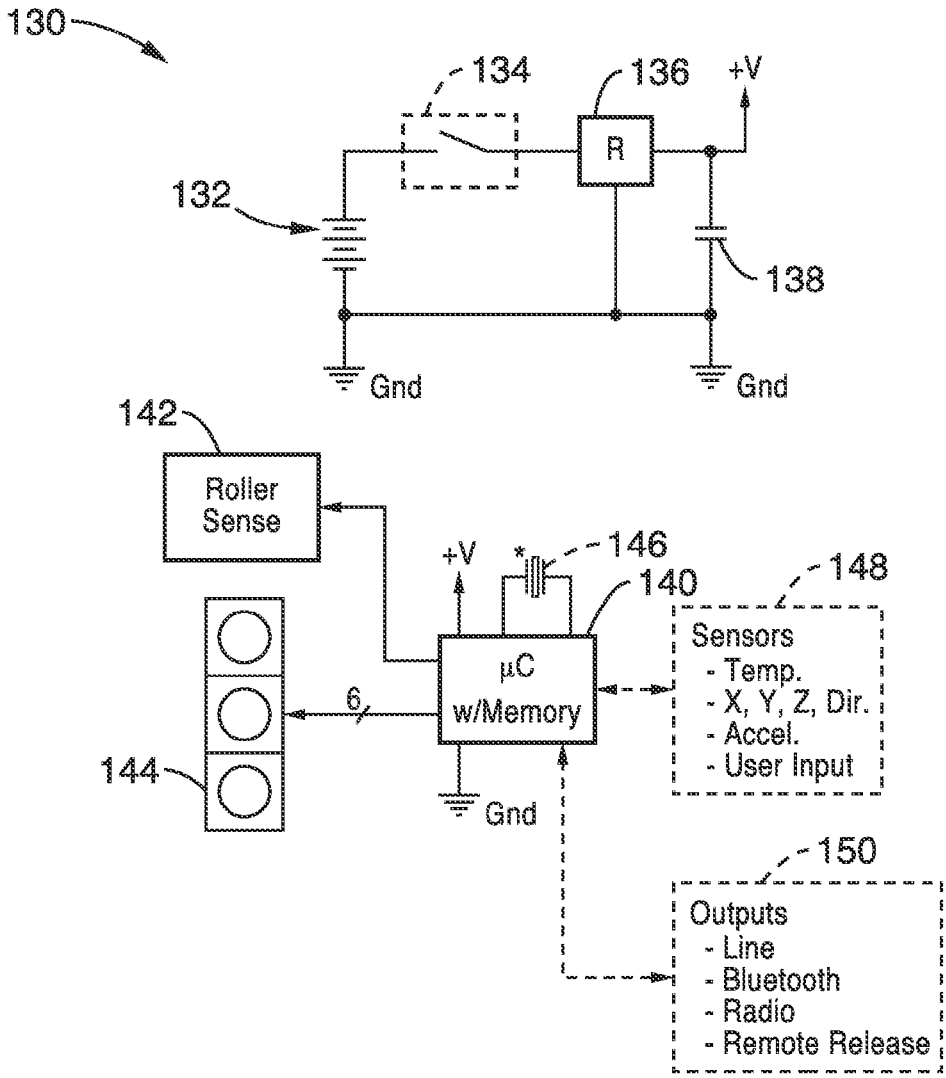
FIG. 14 is a schematic of tracer line electronics according to at least one embodiment of the present invention.
Figure 15:
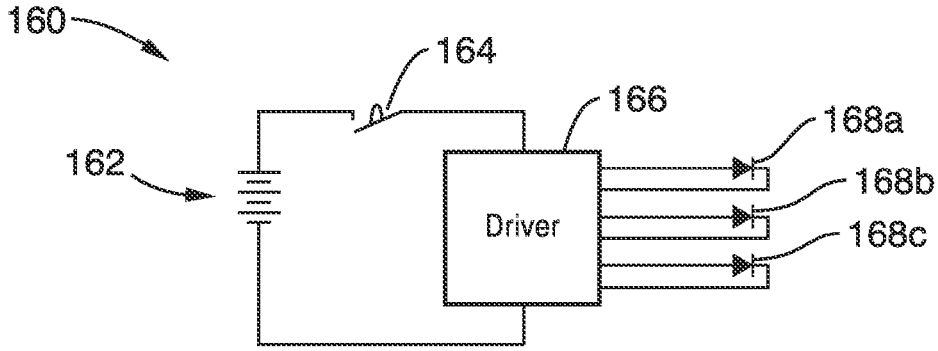
FIG. 15 is a schematic of lighted beacon electronics within the multi-attach anchor head according to at least one embodiment of the present invention.

FIG. 14 through FIG. 15 illustrate example circuit embodiments for the tracer line housing circuit 130 and multi-attach anchor head 16. The circuit embodiment 130 of the tracer line housing depicts a housing battery 132 with a switch 134 (or switch module), regulator 136 and conditioning circuit 138, such as a capacitor, for providing power to the electronics in the tracer line housing. Switch 134 can comprise a mechanical switch, or an electronic switch, which is activated in response to extension of the tether line.

A control circuit 140, such as comprising a microcontroller with memory and input/output lines, or other control circuit, is shown for controlling the electronic functions of the tracer line device. It will be appreciated that any desired processing elements, component circuits, and/or custom circuits, can be utilized for controlling all the electronic functions within the apparatus. It should be noted that every function described below will not be implemented in every embodiment of the present invention.

A line motion sensor 142 is configured for detecting the amount of line that is extended from, and retracted into, tracer line housing. As previously described, this sensor can comprise a mechanical, magnetic or optical sensor.

A set of indicator lights 144 are shown of the multi-element indicator 24 which are controlled by control circuit 140. Each of these lights may comprise an LED having a single color element, a dual color element (e.g., red and green), or a multi-color element (e.g., red, green and blue). The control circuit outputs status information through indicator lights 144 as well as the state of tracer line extension. In one implementation, programming of the microcontroller, determine how and when to output status information.

By way of example and not limitation, the distance of line extension is indicated in response to the state of the three lights as follows: 1 steady light=10 feet, 2 steady lights=20 feet, 3 steady lights=30 feet, 1 blinking light=40 feet, 2 blinking lights=50 feet, and 3 blinking lights=60 feet.

An optional audio annunciator 146 (e.g., piezoelectric transducer) is shown for generating status and alert signals.

A set of optional inputs 148 is shown for registering user control inputs and sensor inputs. Examples already described include temperature sensing. Other sensor inputs can include a position sensor input, such as from a GPS, inertial sensor, or similar according to one or more embodiments.

A set of optional outputs 150 is shown for controlling elements of the invention according to one or more embodiments. For example, status information from the tracer line apparatus can be communicated over a Blue Tooth communication channel, or similar short range radio transceiver, for relay through the main radio system of the rescue worker to persons monitoring the safety of the rescue workers. The device may alternatively output status and other information by a radio transmitter/transceiver, such as over the line as an antenna, or similar.

A remote anchor release can be configured according to aspects of the invention, in which the anchor head is electrically released from its anchor position, in response to user input on the tracer line housing.

It will be appreciated that a wide range of inputs and outputs can be controlled by tracer line control circuit, including as described elsewhere in this specification and below regarding the alternative embodiments.

In FIG. 15, a beacon circuit 160, of multi-attach anchor head 16 or 110, is configured for outputting a visible beacon so that the user, and other personnel, can visually identify anchor positions (where an anchor head with beacon has been engaged). Power is derived from an anchor head battery 162 which supplies power through a normally closed (normally ON when switch in uncompressed state) switch 164 to a driver circuit 166 which drives power through illuminating elements 168*a*, 168*b*, 168*c*. It will be appreciated that any desired number of optical elements may be utilized, and these may be single color or multicolor elements, such as light emitting diodes (LEDs).

Switch 164 is preferably configured for activating the beacon lights when the tether line is extended, such as sensed in response to removing the anchor head from the housing. For example switch 164 preferably comprises a magnetic reed switch, or similar, which is retained in an open (OFF) position when the anchor head is in the housing and under the influence of a sufficient magnetic field emanating from a magnet therein, and changes to a closed state (ON) as the anchor head is removed from the housing.

In a preferred embodiment, driver circuit 166 includes a flashing control circuit, such as a microcontroller, which sequences the activation of the light elements to create a distinctive pattern to increase cognition while reducing overall power consumption in relation to always having the lights activated. For simplicity of illustration, a series of three single-color LEDs are shown being driven, however, it will be appreciated that any number and/or combination of single and multicolor lights can be incorporated toward increased recognition range.

In a preferred embodiment an inexpensive microcontroller is utilized for controlling beacon light activation, when power is first received by the device it performs a battery self-test and accordingly sets the beacon lights to indicate battery state (e.g., good, questionable, or bad). One simple way of registering battery voltage on a microcontroller comprises discharging an output port, then changing the port to an input mode and registering the time required for this node to charge through a resistor from the battery, toward reaching the high logic threshold. The time can be mapped to a measure of battery voltage, with the processor retaining a table to map the times into the associated battery states.

In one embodiment, the batteries of the beacon light may be separately replaced, while in another embodiment, the entire beacon module is replaced with a module containing a fresh battery.

3. Alternative Embodiments

The tracer line apparatus is configured to allow implementation with a variety of options to further enhance safety and operational convenience, the following are described by way of example and not limitation. These elements, as well as those described above, can be implemented separately, or in combination with one another.

Vertical Tether Capability.

As has been discussed, by augmenting the line extension speed control and increasing the weight bearing capability of the belt clip, line and spool mechanism, the tracer line device can be configured to also provide limited vertical tether line capability. Although adding weight and cost to the device, the vertical capability provides additional safety for crews subject to vertical falls.

Line Visibility.

In at least one additional embodiment of the invention, the tether line is reflective, or more preferably electrically illuminated. By way of example and not limitation, the lighting is preferably generated along the length of the line, such as driving an electroluminescent lighting source along the length of the line. It will be appreciated that the cost of manufacturing illuminated lines (even containing embedded wiring) has dropped dramatically in recent years. Other forms of light generation elements can be utilized, such as using distributed organic LED lighting whose layers can be used as cladding on the line, and so forth. In addition, light may be directed from the housing through a substantially transparent line adapted for radially dispersing a small portion of the light per foot of traversal along the line. Certain implementations of lighted line are accomplished using active line implementation in which signals are carried through the line.

Active Line Implementations.

Different embodiments of the present invention can be implemented to include an active line wherein signals are carried along the line to support one or more of the following features. The signal can be carried by an optical fiber, or alternatively over limited conduction wiring. For example, a synthetic line may be utilized which incorporates a plurality of resistive conductors (e.g., pass sufficient current for signaling, while preventing dangerous levels of current flow). The cost of embedding signal lines in a synthetic line medium is dropping, allowing a variety of active line configurations to be supported as described below.

Remote Anchor Release.

At least one implementation of the apparatus includes a remote anchor release. By way of example the remote anchor release allows the anchor to be released without the need of returning to the location of the anchor to disconnect it. The remote release may be operated in response to sending a signal through the line to the remote head or by wireless transmissions, as desired.

Remote Sensing.

In one implementation of the invention, the multi-attach anchor head, and/or the line itself incorporate sensors, such as to sense dangerous heating. For example, a heat sensor in the multi-attach anchor head and/or located along the length of the line to transmit heat information back to the housing. An annunciator in the housing, such as the multi-element indicator or other indicator, can generate warnings to the user of dangerous temperature levels along their egress route back to the where the multi-attach anchor head is anchored. In addition, sensors can be utilized for sensing other conditions, such as chemical sensing, and so forth.

Remote Signaling.

In at least one implementation, the line is configured as a radio-frequency antenna so that signals can be more readily transmitted from the tracer line to ground receiving equipment or other tracer lines operating in a cooperative effort. It will be appreciated that unlike small stub antennas, the extended line can provide significant improvements in signal radiance. Examples of transmission include radio beacons for receiving passive status information (e.g., user need not actively "radio in" a report), sending location information, and so forth.

Radio Beacon.

In one implementation, the tracer line apparatus is adapted with a radio beacon which allows communicating status in relation to the user as transmitted to other personnel, such as on the ground outside or within the same structure, and thus increasing the cooperative element. Beacon signals are preferably generated using MIMO (multiple input multiple output) and/or spread-spectrum technology to assure that the signals are always properly registered despite interference from the building. In one implementation, an antenna element is embedded within the tether line itself so that the signal is generated over a long span. In at least one implementation status information (e.g., deployment of anchor head, line extended from anchor head, temperature, and so forth) can be transmitted for tracking the safety of the user.

Positional Tracking.

In at least one implementation, a GPS tracking element is integrated into the device to provide for registration of location in three dimensions, based on longitude, latitude and altitude. This feature is particularly useful when coupled to a radio-beacon option, wherein the location of each user can be easily tracked. In addition, the GPS device is preferably configured to register which floor the user is at in the building. This floor reset function is facilitated by resetting the device at the base of the building, and can allow users to select the distance between floors, if different from a default setting (such as 10 feet). Tracer line apparatus can include a number of optional features including, radio transmission (or transceiver) to generate status information to other personnel, to alert of distress situations, to generate location signals in case the user cannot extricate themselves. In addition, with optional transceiver, the user can still maintain some communications with others even if their primary radio has malfunctioned. A global positioning (GPS) option within the device allows the user to determine exact locations in relation to a building structure, and read out which floor they are operating on. In addition, in one mode the GPS coordinates are transmitted periodically to ground personnel for tracking the locations of each user.

4. Tracer Line Operation

The Tracer Line apparatus provides a number of benefits to the fire fighter or other safety personnel. The tracer line allows the user to readily find their way back to the point of entry, while increasing safety over other devices. Secure attachment and convenient release is assured by a double lock belt clip system and a line retraction brake that activates when the tracer is disconnected from the user.

Tracer Line is a self-retractable horizontal search line which easily engages door jambs, or other structures, or can be tied-off to stationary objects. Alternate embodiments of the tracer line can also provide vertical rappel capabilities.

Lines can be readily attached (secured) between a door and its door jamb using the anchor head in a single hand operation. The door jamb anchor securely locks itself into any door jamb gap when it is twisted. Securement of the anchor can be performed in other ways, such as in response to anchor head clamping on other structures and by means of tying off the line after wrapping it around an anchor point if a suitable door jamb location is unavailable. The anchor head is interchangeable with different anchoring heads for different purposes and types of structures.

A lock mechanism allows the user to hold the line from retracting when the unit is detached from the user, thus preventing the unit from slipping away from the user in the smoke of a fire and stranding the user/rescuer.

In at least one embodiment, an extension braking mechanism limits the rate at which the line extends to provide a controlled descent (rappel) at a controlled speed from the anchor location in an emergency.

A line distance display reads out line status in easily discernable ON and OFF pattern of discrete light outputs to inform the user at a glance how far they have traversed into the building from their tie off point.

A beacon is integrated in the head which activates automatically in response to extending the anchor from the housing and which provides visual reference for the user back to their anchor point, which is typically at or near the point of entry.

Tracer line units can be linked together forming a chain to increase search lengths or distances.

The Tracer Line of the invention can be utilized in numerous application and in response to the use of different head options, such as for fire fighting, rescue, scuba diving, Naval ships, mining, and so forth.

As can be seen from the discussion herein, the present invention provides methods and apparatus for providing position reference for fire crews and other rescue workers, and includes the following inventive embodiments among others:

An apparatus for coupling and maintaining a rescue line from a user to a structural attach point, comprising: a housing configured for attachment to, and wearing by, a user; a spool retained in the housing and configured with a predetermined length of line having a proximal end coupled to the spool and configured for being retained as windings on the spool; a retraction mechanism, within the housing, coupled to the spool which is configured for extending line from the spool in response to application of an extension force; a retraction brake mechanism, coupled to the retraction mechanism, configured for stopping line retraction in response to the housing becoming disengaged from the user; a multi-attach anchor head coupled to the distal end of the length of line and configured with a twist-lock engagement mechanism for anchoring to a door and frame, or other structural member, as an attachment point within a structure; and a beacon assembly disposed on the multi-attach anchor head and configured for outputting a light pattern to facilitate user locating of the attachment point within the structure.

The apparatus further comprising a belt clip which attaches to the housing and is configured for attachment to a belt, harness, and/or strap of the user, in response to the attachment to, and wearing by the user.

Wherein the retraction brake mechanism operates in response to the belt clip being disengaged from the housing, and thus separated from the user.

Wherein the belt clip is configured with a dual locking mechanism in which the belt, harness and/or strap is engaged by a first mechanism which is engaged and locked to a second mechanism, toward preventing disengagement of the belt, harness and/or strap.

Wherein locking of the second mechanism is controlled in response to user manipulation of one or more locking buttons.

Wherein the housing is configured for extending line from either the front side or the rear side of the housing.

The apparatus further comprising a plurality of rollers disposed about the internal periphery of the housing to guide the line onto the spool in a desired arrangement.

Wherein the multi-attach anchor head is further configured for engaging any solid structures or coupling the line around an object and back to itself to secure the anchor.

Wherein the multi-attach anchor head is configured for anchoring to a portion of the structure being retained between a first portion of the multi-attach anchor head and a second portion of the multi-attach anchor head; and wherein the twist-lock engagement mechanism is configured to lock the first portion of the multi-attach anchor head to prevent motion in relation to the second portion of the multi-attach anchor head to provide a secure anchoring of the multi-attach anchor head to the structure.

The apparatus further comprising a multiple stage debris guard configured for removing debris from the line as it is retracted into the housing, and to direct liquids to fall through a slotted retraction opening in the housing.

The apparatus further comprising: a multi-element indicator configured for outputting a discrete lighting pattern indicative of the amount of line which has been extended from the housing; and wherein the discrete lighting pattern comprises a pattern of solid and blinking lights which indicate predetermined thresholds of line extension have been reached.

Wherein the beacon is configured for automatically activating in response to extension of the multi-attach anchor head from the housing.

Wherein the retraction mechanism comprises a power spring which is geared up through concentric gears to drive the spool, which rotates a plurality of times for each rotation of the power spring.

Wherein the beacon is configured to generate one of a plurality of lighting patterns.

An additional embodiment of the apparatus for coupling and maintaining a rescue line from a user to a structural attach point, comprising: a housing; a belt clip which attaches to the housing and is configured for attachment to a belt, harness, and/or strap, of a user, for wearing by the user; a spool retained in the housing and configured with a length of line having a proximal end coupled to the spool and configured for being retained as windings on the spool; a retraction mechanism within the housing and coupled to the spool which is configured for extending line from the spool through either the front side or rear side of the housing in response to application of a sufficient extension force; a retraction brake mechanism, coupled to the retraction mechanism, configured for stopping line retraction when the housing is disengaged from the user; wherein the retraction brake mechanism operates in response to the belt clip being disengaged from the housing; a multi-attach anchor head coupled to the distal end of the length of line and configured with an engagement mechanism for anchoring to a door and frame, or other structural member, as an attachment point within a structure; and a beacon assembly, on the multi-attach anchor head, configured for outputting a light pattern to facilitate user locating of the attachment point within the structure.

Wherein the retraction brake mechanism is configured to engage its brake in response to the belt clip being disengaged from the housing.

Wherein the belt clip is configured with a dual locking mechanism in which the belt, harness and/or strap is engaged by a first mechanism which is then engaged and locked into a second mechanism, toward preventing disengagement the belt, harness and/or strap; and wherein locking of the second mechanism is controlled in response to user manipulation of one or more locking buttons.

The additional embodiment apparatus further comprising: a pivoting chock element which extends from a nosepiece of the multi-attach anchor head in response to pressure applied to a handle of the multi-attach anchor head for insertion and rotation in the gap between a door and the door frame; and a twist lock mechanism, in the multi-attach anchor head, which engages upon release of the handle to set the anchor in a locked position which prevents re-extension of the chock and locks out rotation thereof.

The additional embodiment apparatus further comprising: a planar capture structure, which extends from said multi-attach anchor head, configured for engaging a structural member of a building within a channel area through a spring entry opening for anchoring the multi-attach anchor head to the building; and a pair of extendable engagement flaps which deploy in response to movements of a handle portion of the multi-attach anchor head and operates in conjunction with the planar capture structure for anchoring to the structural member.

An additional embodiment apparatus for maintaining a rescue line from a user to a point of ingress or egress within a structure, comprising: a housing configured for attachment to, and wearing, by a user; a spool retained in the housing and configured with a length of line having a proximal end coupled to the spool and configured for being retained as windings on the spool; a retraction mechanism within the housing and coupled to the spool which is configured for extending line from the spool in response to application of a sufficient extension force; a retraction brake mechanism, coupled to the retraction mechanism, configured for stopping line retraction when the housing is disengaged from the user; a multi-element visual indicator configured for detecting the movement of one of said plurality of rollers and outputting a visual indication of line extension in response thereto; a multi-attach anchor head coupled to the distal end of the length of line and configured with an engagement mechanism for anchoring to a door and frame, or other structural member, as an attachment point at a point of ingress or egress within a structure; and a beacon assembly, on the multi-attach anchor head, configured for outputting a light pattern to facilitate user locating of the attachment point within the structure.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, compositional, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for coupling and maintaining a rescue line from a user to a structural attach point, comprising:

a housing configured for attachment to, and wearing by, a user;

a spool retained in said housing and configured with a predetermined length of line having a proximal end coupled to said spool and configured for being retained as windings on said spool;

a retraction mechanism, within said housing, coupled to said spool which is configured for extending line from said spool in response to application of an extension force;

a retraction brake mechanism, coupled to said retraction mechanism, configured for stopping line retraction in response to said housing becoming disengaged from the user;

a multi-attach anchor head coupled to the distal end of said length of line and configured with a twist-lock engagement mechanism for anchoring to a door and frame, or other structural member, as an attachment point within a structure; and a beacon assembly disposed on said multi-attach anchor head and configured for outputting a light pattern to facilitate user locating of the attachment point within the structure.

2. The apparatus as recited in claim 1, further comprising a belt clip which attaches to said housing and is configured for attachment to a belt, harness, and/or strap of the user, in response to said attachment to, and wearing by the user.

3. The apparatus as recited in claim 2, wherein said retraction brake mechanism operates in response to said belt clip being disengaged from said housing, and thus separated from the user.

4. The apparatus as recited in claim 2, wherein said belt clip is configured with a dual locking mechanism in which the belt, harness and/or strap is engaged by a first mechanism which is engaged and locked to a second mechanism, toward preventing disengagement of said belt, harness and/or strap.

5. The apparatus as recited in claim 4, wherein locking of said second mechanism is controlled in response to user manipulation of one or more locking buttons.

6. The apparatus as recited in claim 1, wherein said housing is configured for extending line from either the front side or the rear side of said housing.

7. The apparatus as recited in claim 1, further comprising a plurality of rollers disposed about the internal periphery of the housing to guide the line onto the spool in a desired arrangement.

8. The apparatus as recited in claim 1, wherein said multi-attach anchor head is further configured for engaging any solid structures or coupling said line around an object and back to itself to secure said anchor.

9. The apparatus as recited in claim 1, wherein said multi-attach anchor head is configured for anchoring to a portion of the structure being retained between a first portion of said multi-attach anchor head and a second portion of said multi-attach anchor head; and wherein said twist-lock engagement mechanism is configured to lock said first portion of said multi-attach anchor head to prevent motion in relation to said second portion of said multi-attach anchor head to provide a secure anchoring of said multi-attach anchor head to the structure.

10. The An apparatus as recited in claim 1, further comprising a multiple stage debris guard configured for removing debris from the line as it is retracted into said housing, and to direct liquids to fall through a slotted retraction opening in the housing.

11. The apparatus as recited in claim 1, further comprising: a multi-element indicator configured for outputting a discrete lighting pattern indicative of the amount of line which has been extended from said housing; wherein said discrete lighting pattern comprises a pattern of solid and blinking lights which indicate predetermined thresholds of line extension have been reached.

12. The apparatus as recited in claim 1, wherein said beacon is configured for automatically activating in response to extension of said multi-attach anchor head from said housing.

13. The apparatus as recited in claim 1, wherein said retraction mechanism comprises a power spring which is geared up through concentric gears to drive the spool, which rotates a plurality of times for each rotation of said power spring.

14. The apparatus as recited in claim 1, wherein said beacon is configured to generate one of a plurality of lighting patterns.

15. An apparatus for coupling and maintaining a rescue line from a user to a structural attach point, comprising:

a housing;

a belt clip which attaches to said housing and is configured for attachment to a belt, harness, and/or strap, of a user, for wearing by the user;

a spool retained in said housing and configured with a length of line having a proximal end coupled to said spool and configured for being retained as windings on said spool;

a retraction mechanism within said housing and coupled to said spool which is configured for extending line from said spool through either the front side or rear side of said housing in response to application of a sufficient extension force;

a retraction brake mechanism, coupled to said retraction mechanism, configured for stopping line retraction when said housing is disengaged from the user; wherein said retraction brake mechanism operates in response to said belt clip being disengaged from said housing;

a multi-attach anchor head coupled to the distal end of said length of line and configured with an engagement mechanism for anchoring to a door and frame, or other structural member, as an attachment point within a structure; and a beacon assembly, on said multi-attach anchor head, configured for outputting a light pattern to facilitate user locating of the attachment point within the structure.

16. The apparatus as recited in claim 15, wherein said retraction brake mechanism is configured to engage its brake in response to said belt clip being disengaged from said housing.

17. The apparatus as recited in claim 15, wherein said belt clip is configured with a dual locking mechanism in which the belt, harness and/or strap is engaged by a first mechanism which is then engaged and locked into a second mechanism, toward preventing disengagement said belt, harness and/or strap; and wherein locking of said second mechanism is controlled in response to user manipulation of one or more locking buttons.

18. The apparatus as recited in claim 15, further comprising: a pivoting chock element which extends from a nosepiece of said multi-attach anchor head in response to pressure applied to a handle of said multi-attach anchor head for insertion and rotation in the gap between a door and the door frame; and a twist lock mechanism, in said multi-attach anchor head, which engages upon release of said handle to set the anchor in a locked position which prevents re-extension of the chock and locks out rotation thereof.

19. The apparatus as recited in claim 15, further comprising: a planar capture structure, which extends from said multi-attach anchor head, configured for engaging a structural member of a building within a channel area through a spring entry opening for anchoring the multi-attach anchor head to the building; and a pair of extendable engagement flaps which deploy in response to movements of a handle portion of said multi-attach anchor head and operates in conjunction with said planar capture structure for anchoring to the structural member.

20. An apparatus for maintaining a rescue line from a user to a point of ingress or egress within a structure, comprising:

a housing configured for attachment to, and wearing, by a user;

a spool retained in said housing and configured with a length of line having a proximal end coupled to said spool and configured for being retained as windings on said spool;

a retraction mechanism within said housing and coupled to said spool which is configured for extending line from said spool in response to application of a sufficient extension force;

a retraction brake mechanism, coupled to said retraction mechanism, configured for stopping line retraction when said housing is disengaged from the user;

a multi-element visual indicator configured for detecting the movement of one of a plurality of rollers and outputting a visual indication of line extension in response thereto;

a multi-attach anchor head coupled to the distal end of said length of line and configured with an engagement mechanism for anchoring to a door and frame, or other structural member, as an attachment point at a point of ingress or egress within a structure; and a beacon assembly, on said multi-attach anchor head, configured for outputting a light pattern to facilitate user locating of the attachment point within the structure.

* * * * *